US010919126B2

(12) United States Patent
Wilson et al.

(10) Patent No.: US 10,919,126 B2
(45) Date of Patent: Feb. 16, 2021

(54) SYSTEMS AND METHODS FOR MAKING ABRASIVE ARTICLES

(71) Applicant: 3M INNOVATIVE PROPERTIES COMPANY, St. Paul, MN (US)

(72) Inventors: Geoffrey I. Wilson, Woodbury, MN (US); Brian G. Koethe, Cottage Grove, MN (US); Steven J. Keipert, Houlton, WI (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 654 days.

(21) Appl. No.: 15/736,188

(22) PCT Filed: Jul. 1, 2016

(86) PCT No.: PCT/US2016/040618

§ 371 (c)(1),
(2) Date: Dec. 13, 2017

(87) PCT Pub. No.: WO2017/007703

PCT Pub. Date: Jan. 12, 2017

(65) Prior Publication Data

US 2018/0169836 A1 Jun. 21, 2018

Related U.S. Application Data

(60) Provisional application No. 62/189,980, filed on Jul. 8, 2015.

(51) Int. Cl.
*B24D 11/00* (2006.01)
*B24D 18/00* (2006.01)

(52) U.S. Cl.
CPC ..... *B24D 11/003* (2013.01); *B24D 18/0072* (2013.01); *B05D 2252/00* (2013.01); *B05D 2401/00* (2013.01)

(58) Field of Classification Search
CPC ..... B24D 11/003; B24D 18/0072; B05D 2252/00; B05D 2401/00
See application file for complete search history.

(56) References Cited

U.S. PATENT DOCUMENTS

2003/0009949 A1 1/2003 Prichard
2003/0207659 A1 11/2003 Annen
(Continued)

FOREIGN PATENT DOCUMENTS

DE 102013212609 12/2014
DE 102013212684 12/2014
(Continued)

OTHER PUBLICATIONS

International Search Report for PCT/US2016/040618 dated Oct. 18, 2016 (4 pages).

*Primary Examiner* — Pegah Parvini

(57) ABSTRACT

Methods of making an abrasive article. Abrasive particles are loaded to a distribution tool including a plurality of strips defining a plurality of channels. Each channel is open to a lower side of the tool. The loaded particles are distributed from the distribution tool to a major face of a backing web below the lower side. At least a majority of the particles distributed from the tool undergo an orientation sequence in which each particle first enters one of the channels. The particle then passes partially through the channel such that a first portion is beyond the lower side and in contact with the major face, and a second portion within the channel. The sequence then includes the particle remaining in simultaneous contact with one of the strips and the major face for a dwell period.

20 Claims, 18 Drawing Sheets

(56) References Cited

U.S. PATENT DOCUMENTS

| | | | | |
|---|---|---|---|---|
| 2006/0254154 | A1* | 11/2006 | Huang | B24B 7/228 51/293 |
| 2006/0288647 | A1 | 12/2006 | Thurber | |
| 2007/0044384 | A1 | 3/2007 | Larson | |
| 2008/0102720 | A1 | 5/2008 | Rostal | |
| 2008/0152856 | A1 | 6/2008 | Keipert | |
| 2009/0169816 | A1 | 7/2009 | Erickson | |
| 2009/0325466 | A1 | 12/2009 | Kincaid | |
| 2010/0146867 | A1 | 6/2010 | Boden | |
| 2010/0151196 | A1 | 6/2010 | Adefris | |
| 2010/0319269 | A1 | 12/2010 | Erickson | |
| 2011/0289854 | A1 | 12/2011 | Moren | |
| 2012/0227333 | A1 | 9/2012 | Adefris | |
| 2013/0040537 | A1 | 2/2013 | Schwabel | |
| 2013/0125477 | A1 | 5/2013 | Adefris | |
| 2013/0344786 | A1* | 12/2013 | Keipert | B24D 3/28 451/529 |
| 2014/0000176 | A1 | 1/2014 | Moren | |
| 2014/0106126 | A1 | 4/2014 | Gaeta | |
| 2014/0290147 | A1 | 10/2014 | Seth | |
| 2015/0290771 | A1* | 10/2015 | Li | B24D 18/0018 51/295 |
| 2016/0144480 | A1* | 5/2016 | Eugster | B24D 3/001 451/541 |

FOREIGN PATENT DOCUMENTS

| | | |
|---|---|---|
| EP | 1 122 030 | 8/2001 |
| WO | WO 2010/077519 | 7/2010 |

* cited by examiner

SYSTEMS AND METHODS FOR MAKING ABRASIVE ARTICLES

CROSS REFERENCE TO RELATED APPLICATIONS

This application is a national stage filing under 35 U.S.C. 371 of PCT/US2016/040618, filed Jul. 1, 2016, which claims the benefit of US Provisional Patent Application No. 62/189980, filed Jul. 8, 2015, the disclosures of which are incorporated by reference in their entirety herein.

BACKGROUND

The present disclosure relates to abrasive articles. More particularly, it relates to tools, systems and methods for arranging abrasive particles on a backing as part of the manufacture of an abrasive article.

In general, coated abrasive articles have an abrasive layer secured to a backing. The abrasive layer comprises abrasive particles and a binder that secures the abrasive particles to the backing. One common type of coated abrasive article has an abrasive layer comprised of a make coat or layer, a size coat or layer, and abrasive particles. In making such a coated abrasive article, a make layer precursor comprising a curable make resin is applied to a major surface of the backing. Abrasive particles are then at least partially embedded into the curable make resin, and the curable make resin is at least partially cured to adhere the abrasive particles to the major surface of the backing. A size layer precursor comprising a curable size resin is then applied over the at least partially cured curable make resin and abrasive particles, followed by curing of the curable size resin precursor, and optionally further curing of the curable make resin.

Application of the abrasive particles to a major face of a backing construction (e.g., a backing coated with a make layer precursor) is oftentimes accomplished via drop coating technique in which a bulk supply of the abrasive particles are fed through a hopper and fall onto the major face (e.g., onto or into the make layer precursor) under the force of gravity. A spatial orientation of the abrasive particles upon contacting the major face is entirely random in all directions. Alternatively, electrostatic coating (e-coat) is also well known, and generally employs an electrostatic field to propel the abrasive particles vertically against the force of gravity onto the major face (e.g., onto or into the make layer precursor). With electrostatic coating, it is possible to effect the orientation of the abrasive particles in one direction such that each abrasive particle's elongated dimension is substantially erect (standing up) with respect to the backing surface. Rotational orientation about the major axis remains random. Electrostatic coating is more complex than drop coating, and may not be viable with all types of abrasive particles (e.g., it can be difficult to consistently electrostatically coat relatively large abrasive particles).

In light of the above, a need exists for improved systems and methods for applying abrasive particles to a backing construction as part of the manufacture of an abrasive article.

SUMMARY

Some aspects of the present disclosure are directed toward methods of making abrasive articles. The method includes loading abrasive particles to a distribution tool. The distribution tool includes a plurality of strips defining a plurality of channels. Each of the channels is open to a lower side of the distribution tool. The loaded abrasive particles are distributed from the distribution tool on to a major face of a backing construction web located immediately below the lower side and moving relative to the distribution tool. At least a majority of the abrasive particles distributed from the distribution tool undergo a particle orientation sequence in which each particle first enters one of the channels. The particle then passes partially through the corresponding channel such that a first portion of the abrasive particle is beyond the lower side and in contact with the major face, and a second portion of the abrasive particle is within the channel. The particle orientation sequence then includes the abrasive particle remaining in simultaneous contact with at least one of the strips and the backing major face for a dwell period during. Optionally, the backing construction web moves relative to the distribution tool and/or vice-versa. In some embodiments, the method includes a plurality of the abrasive particles being simultaneously located within, and grossly aligned relative to, a respective one of the channels. In other embodiments, the orientation sequence includes the abrasive particle experiencing a natural re-orientation (e.g., tilting) following initial contact with the major face and while the second portion is within the confines of the corresponding channels. In yet other embodiments, the channel width is less than a nominal height and nominal length of the abrasive particles, but is greater than a nominal thickness.

Other aspects of the present disclosure are directed toward systems for making abrasive articles. The system includes a distribution tool, a web feeding device, and an abrasive particle feed device. The distribution tool defines an entrance side, an exit side and a lower side. Further, the tool includes a plurality of spaced apart elongated strips combining to define a plurality of channels. Each of the channels extends between the entrance and exit sides, and is open to a lower side of the distribution tool. A length of each channel is greater than a corresponding channel width. The web feeding device is configured to deliver a backing construction web in a machine direction immediately below the lower side of the distribution tool. The abrasive particle feed device is configured to dispense a plurality of abrasive particles from an outlet, with the outlet being arranged over the entrance side of the distribution tool. In some embodiments, the strips are strings held in tension by a frame.

DETAILED DESCRIPTION

Figure 1:
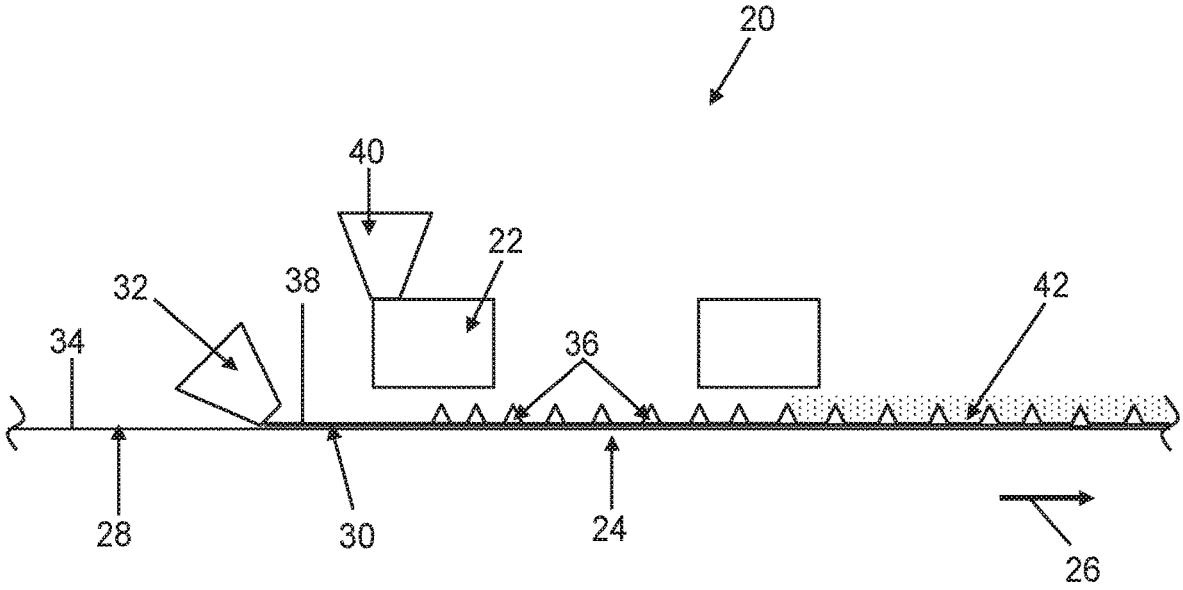
FIG. 1 is a simplified illustration of a portion of a system for manufacturing abrasive articles in accordance with principles of the present disclosure.

Aspects of the present disclosure relate to tools, systems and methods for manufacturing abrasive articles, and in particular devices and methods for applying abrasive particles to a backing construction. As a point of reference, FIG. 1 illustrates portions of a system 20 for manufacturing abrasive articles in accordance with principles of the present disclosure, including a distribution device 22 along with other components or devices commonly employed in the manufacture of abrasive articles. For example, the manufacture of abrasive articles conventionally includes structures and mechanisms (e.g., rollers, conveyor belts, etc.) for moving a backing construction web 24 along a path of travel or machine direction 26. The backing construction web 24 can assume various forms, and in some embodiments includes a backing 28 to which a make coat precursor resin 30 (or other resin or adhesive) has been applied. For example, with the non-limiting arrangement of FIG. 1, the backing 28 is advanced past a coater 32 that applies the make coat precursor resin 30 on a major surface 34 of the backing 28 thereby creating the backing construction web 24 (e.g., a coated backing). In other embodiments, multiple coatings can be applied to the backing 28 to generate the backing construction web 24 as delivered to the distribution tool 22; in yet other embodiments, the backing construction web 24 consists of the backing 28 alone (i.e., prior to interacting with the distribution device 22, the backing 28 is not subjected to a resin coating operation). Abrasive particles 36 (a size of which is exaggerated in FIG. 1 for ease of understanding) are applied to a major face 38 of the backing construction web 24 by the distribution device 22 that otherwise distributes the abrasive particles 36 from a supply 40 as described below. After application of the abrasive particles 36, the backing construction web 24 exits the distribution device 22 and is optionally subjected to further processing (e.g., application of a size coat 42, application of additional abrasive particles by conventional means (e.g., e-coat), application of a grinding aid, application of a supersize coat, curing, cutting, etc.) to produce a final abrasive article, such as a coated abrasive article.

Figure 2A:
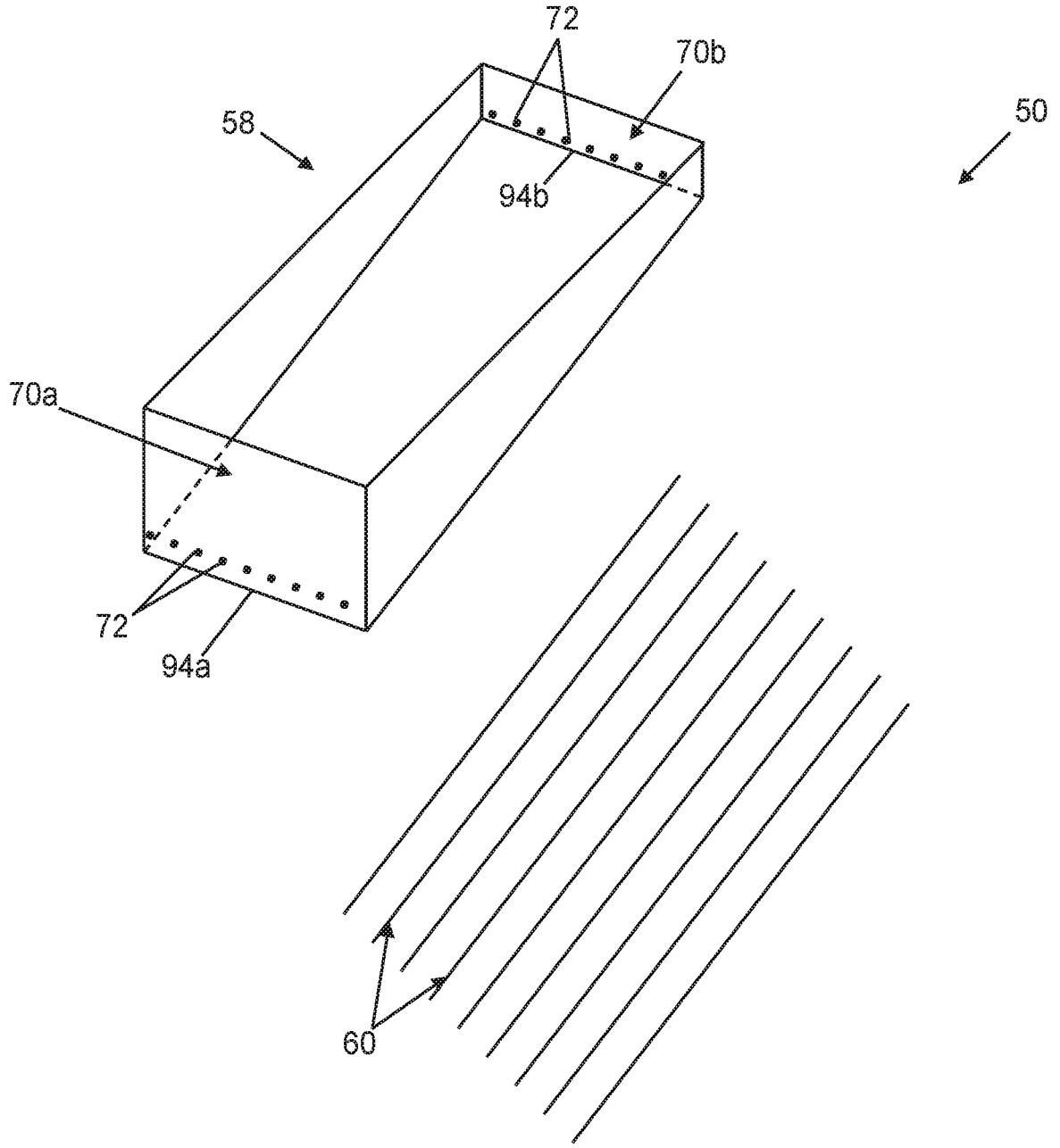
FIG. 2A is a simplified, exploded perspective view of a distribution tool in accordance with principles of the present disclosure and useful with the system of FIG. 1.
Figure 2B:
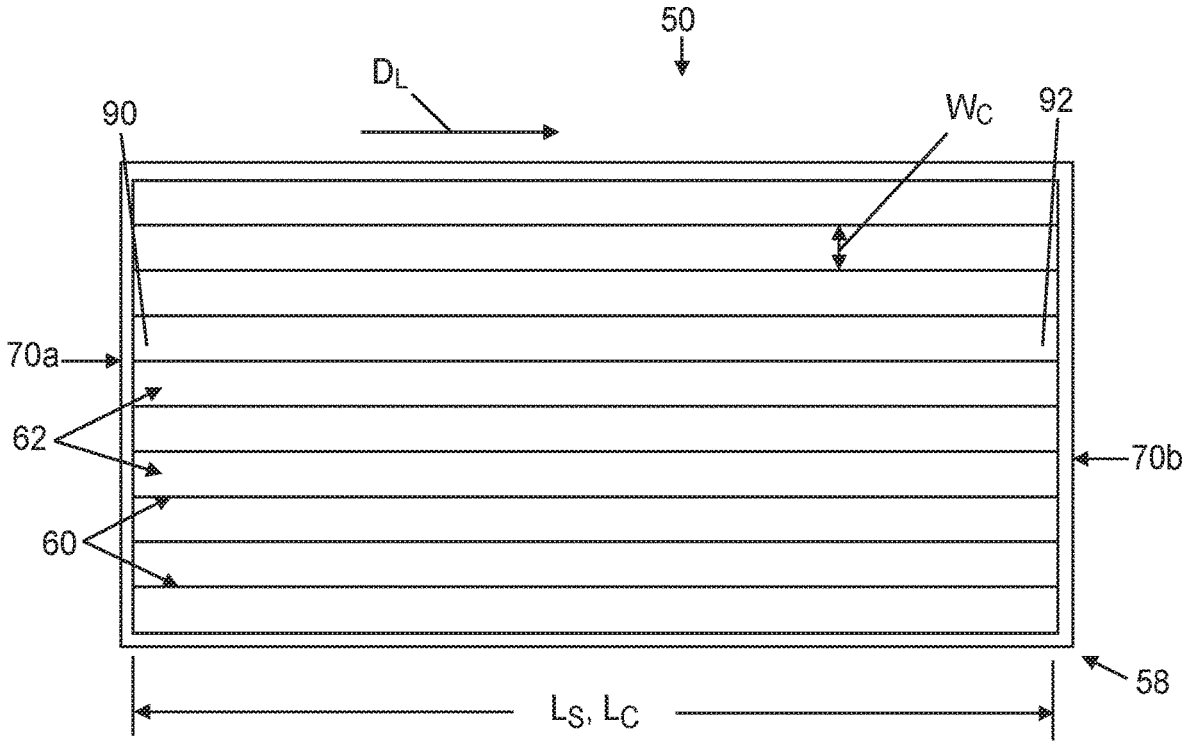
FIG. 2B is a top view of the tool of FIG. 2A.

The distribution device 22 is configured to effectuate gross biased orientation and alignment of at least a majority of the abrasive particles 36 as applied and subsequently bonded to the major face 38. With this in mind, portions of one embodiment of a distribution tool 50 in accordance with principles of the present disclosure and useful with or as the distribution device 22 (FIG. 1) are shown in simplified form in FIG. 2A-2C. In general terms, the distribution tool 50 includes a frame 58 and a plurality of strips 60. The strips 60 are maintained by the frame 58 in a spaced apart manner such that a channel 62 is defined between immediately adjacent ones of the strips 60. The distribution tool 50 is configured to distribute abrasive particles (not shown) from a lower side 64 (referenced generally in FIG. 2C) thereof in a manner that grossly orients and aligns the abrasive particles. For example, and as described in greater detail below, the strands 60 are arranged such that the channels 62 have a substantially similar width $W_C$ (e.g., the width $W_C$ of the channel 62 varies from one another by no more than 10%) that is selected in accordance with expected nominal dimensions of the abrasive particles so as to grossly bias the abrasive particles to a spatial orientation at the lower side 64.

The strips 60 are elongated bodies that either self-maintain, or can be held by the frame 58 in, a substantially linear or planar shape (e.g., within 10% of the truly linear or planar shape). For example, the strips 60 can be strings (e.g., nylon strings), wires, bands, strands, straps, etc., that are held in tension between opposing end walls 70*a*, 70*b* of the frame 58. Alternatively, the strips 60 can have a more rigid and robust construction, and need not be tensioned across the frame 58. Thus, the frame 58 can incorporate various features that facilitate assembly of the strips 60 (e.g., the mounting holes 72 shown in FIG. 2A). Regardless of an exact construction, the frame walls 70*a*, 70*b* maintain the strips 60 in a substantially parallel manner (e.g., the strips 60 are arranged to be within 10% of a truly parallel relationship with one another).

A linear distance between the end walls 70*a*, 70*b* serves to define an effective length $L_s$ of each of the strips 60, as well as a length $L_C$ of each of the channels 62. The channel length $L_C$ is selected in accordance with expected nominal dimensions of the abrasive particles (not shown) with which the distribution tool 50 will be used as described in greater detail below, including the channel length $L_C$ being sufficient to simultaneously receive a multiplicity of the abrasive particles.

The distribution tool 50 is configured such that upon final assembly and use as part of the abrasive article manufacturing system 20 (FIG. 1), abrasive particles (not shown) will become loaded into the channels 62, and subsequently be caused to move relative to the channels 62 in a direction of the channel length $L_C$. Thus, the distribution tool 50 can be viewed has providing a length direction $D_L$, commensurate with the channel lengths $L_C$, from an entrance side 90 to an exit side 92. The first end wall 70*a* is at the entrance side 90, and the second end wall 70*b* is at the exit side 92. As best reflected by FIG. 2C, the frame 58 maintains the strips 60 at an angle relative to horizontal, extending generally upwardly from the entrance side 90 to the exit side 92. The second end wall 70*b* is shorter than the first end wall 70*a* such that a bottom edge 94*a* of the first end wall 70*a* is vertically below (relative to the upright orientation of FIG. 2C) a bottom edge 94*b* of the second end wall 70*b* for reasons made clear below. Alternatively, the strips 60 can be arranged and held substantially parallel to horizontal.

While the distribution tool 50 is illustrated as including nine of the strands 60, any other number, either greater or lesser, is equally acceptable. In more general terms, the number of strips 60 provided with the distribution tool 50 is selected as a function of the desired channel width $W_C$ and a dimension (e.g., cross-web width) of the backing construction web 24 (FIG. 1) as described in greater detail below. In yet other embodiments, the distribution device 22 (FIG. 1) can include two or more of the distribution tools 50 assembled in series to a carrier frame or similar structure.

Figure 3A:
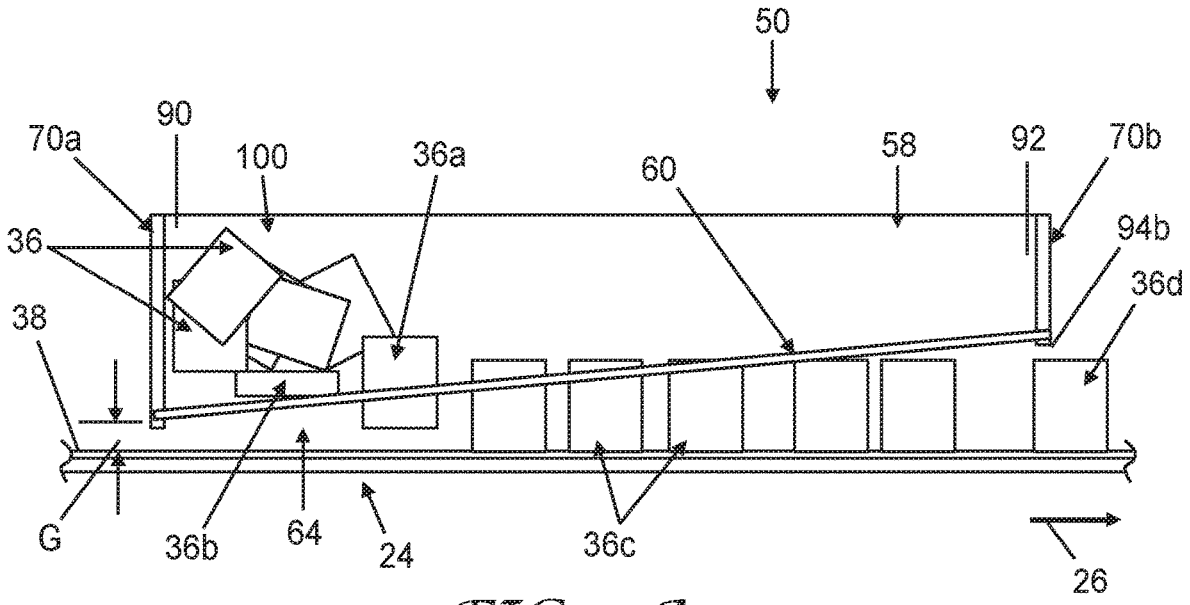
FIG. 3A is a side view of the distribution tool of FIG. 2A as part of a system for manufacturing abrasive articles and distributing abrasive particles on to a web.
Figure 3B:
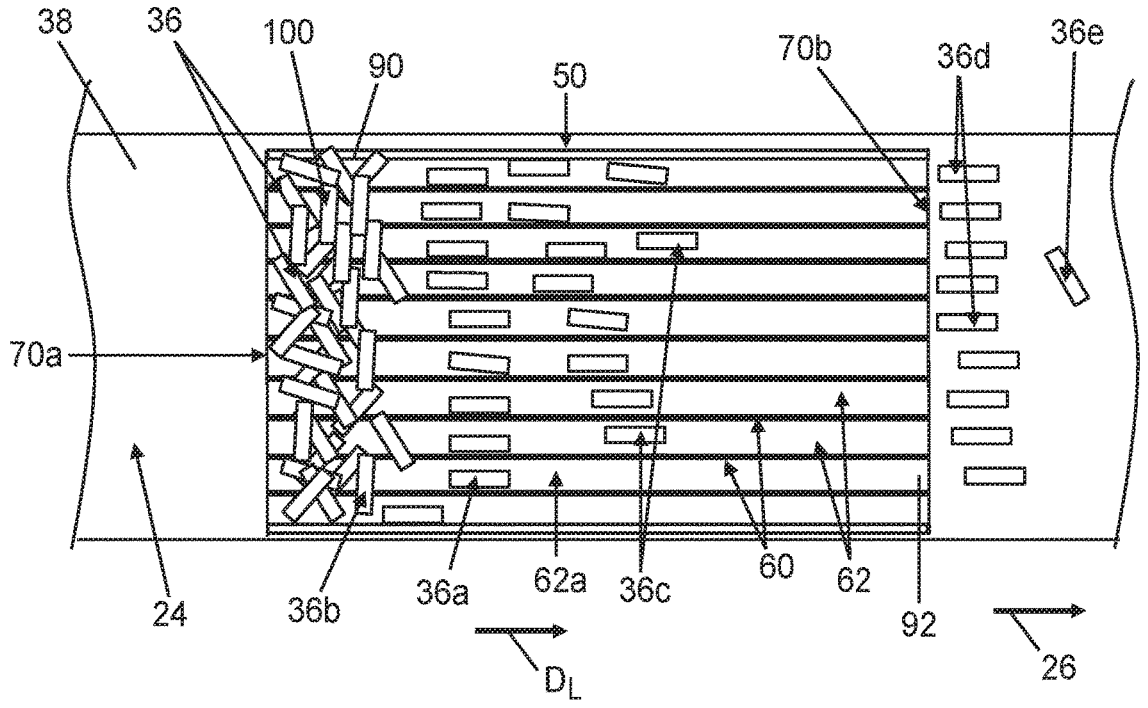
FIG. 3B is a top view of the arrangement of FIG. 3A.
Figure 3C:
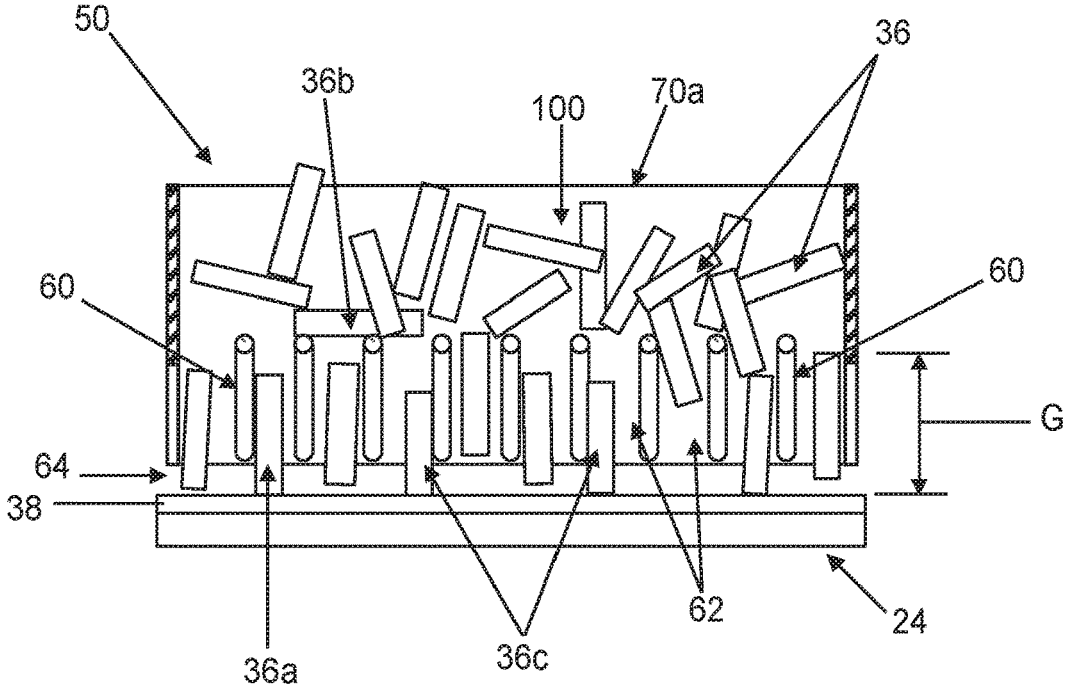
FIG. 3C is an end cross-sectional view of the arrangement of FIG. 3A.

Incorporation of the distribution tool 50 as part of the abrasive article manufacturing system 20 is generally reflected by FIGS. 3A-3C. The distribution tool 50 is located immediately adjacent (e.g., slight above by a distance described in greater detail below) the backing construction web 24. The elongated strips 60 (and thus the channels 62) are substantially aligned (e.g., within 10% of a truly aligned relationship) with the machine direction 26 (e.g., the length direction DL is substantially aligned or parallel with (e.g., within 10% of a truly aligned or parallel relationship) the machine direction 26.

During use, a supply 100 (referenced generally) of the abrasive particles 36 is loaded onto the distribution tool 50 at or adjacent the entrance side 90. Individual ones of the abrasive particles 36 will enter a respective one of the channels 62 only upon achieving a gross spatial orientation dictated by dimensions of the channels 62. For example, a first abrasive particle 36*a* in FIGS. 3A and 3B is spatially oriented so as to enter the channel 62*a*, whereas a spatial orientation of a second abrasive particle 36*b* prevents entry into any of the channels 62. As a point of reference, loading of the supply 100 can include pouring or funneling (e.g., via vibratory feeder, belt driven drop coater, etc.) a large number of the abrasive particles 36 on to the distribution tool 50 under the force of gravity, with individual ones of the so-loaded abrasive particles 36 randomly assuming any spatial orientation. As the individual abrasive particles 36 repeatedly contact one or more of the strips 60, it deflects and assumes a new spatial orientation, eventually becoming generally aligned with and assuming a spatial orientation appropriate for entering one of the channels 62. In this regard, as the supply 100 of the abrasive particles 36 flows on to the strips 60, the strips 60 are caused to vibrate, with this vibration, in turn, causing the abrasive particles 36 to vibrate around on surfaces of the distribution tool 50 until they obtain a suitable orientation and fall through one of the channels 62. Regardless, a large number of abrasive particles 36 can be disposed within individual one of the channels 62 at any one point in time.

Once a necessary spatial orientation is achieved, the so-arranged abrasive particle 36 passes through the corresponding channel 62, falls on to the backing construction web 24 and is at least partially bonded thereto (e.g., the third abrasive particles 36*c* identified in FIGS. 3A-3C). The lower side 64 of the distribution tool 50, and in particular the strips 60, is spaced from the backing construction web 24 by a gap G that, at least at the entrance side 90, is less than a maximum dimension(s) of the abrasive particles 36. Thus, a portion of the applied abrasive particles 36*c* remains within the corresponding channel 62 when located at or near the entrance side 90. The backing construction web 24 is driven relative to the distribution tool 50 in the machine direction 26, such that the applied abrasive particles 36*c* travel relative to the distribution tool 50 with movement of the backing construction web 24, freely sliding within the corresponding channel 62. During this movement, one or more of the strips 60 of the distribution tool 50 support the applied abrasive particles 36*c*, preventing the applied abrasive particles 36*c* from experiencing an overt change in spatial orientation (e.g., the applied abrasive particles 36*c* are preventing from overtly tipping or rotating in a direction perpendicular to the corresponding channel 62). As mentioned above, in some embodiments the strips 60 extend at an angle relative to horizontal, and thus relative to a plane of the backing construction web 24, between the entrance and exit sides 90, 92. With this arrangement, a size of the gap G at the entrance side 90 is less than a size of the gap G at the exit side 92. At the exit side 92, the size of the gap G is greater than the maximum dimension(s) of the abrasive particles 36, as is the distance between the bottom edge 94*b* of the second end wall 70*b* and the backing construction web 24. Thus, the applied abrasive particles 36*c* freely pass beneath the second end wall 70*b*. Alternatively, the strips 60 can be substantially parallel to horizontal, and the direction of the backing construction web 24 can be arranged downward (in the machine direction) to establish the expanding gap G as described above (i.e., the size of the gap G at the entrance side 90 is less than the size of the gap G at the exit side 92). Upon traveling beyond the exit side 92, the abrasive particles 36 are now more firmly bonded to the backing construction web 24 (e.g., abrasive particles 36*d* identified in FIGS. 3A and 3B), and maintain the gross biased orientation and alignment dictated by the distribution tool 50. In other words, systems and methods of the present disclosure include the applied abrasive particles 36*c* being in simultaneous contact with the backing construction web 24 and one (or more) of the strips 60 of the distribution tool 50 over a dwell period in which the applied abrasive particle 36*c* is caused to travel the length of the distribution tool 50 and progress beyond the exit side 92.

In some embodiments, some of the abrasive particles 36 included with the supply 100 dispensed or loaded on to the distribution tool 50 will not experience the gross bias orientation and alignment sequence or steps described above. For example, as the supply 100 flows on to the distribution tool 50 at the entrance side 90, individual ones of the abrasive particles 36 can defect or "bounce" off the strips 60 in a direction of the exit side 92; invariably, individual ones of the abrasive particles 36 will deflect or bounce off of the strips 60, beyond the exit side 92 (i.e., "over" the second end wall 70*b*) and onto the backing construction web 24. FIG. 3B illustrates one example of a random abrasive particle 36*e* that has secured on to the backing construction web 24 without passing through one of the channels 62. Abrasive article manufacturers and end-users may prefer this random occurrence of non-biased abrasive particles 36*e*. Thus, systems and methods of the present disclosure include at least a majority, optionally at least 75%, 85%, 90% or 95%, of the abrasive particles 36 included with the supply 100 as loaded to the distribution tool 50 undergoing a particle orientation sequence in which the abrasive particle 36: 1) enters one of the channels 62; 2) passes partially through the corresponding channel 62 such that a first portion of the abrasive particle is beyond the lower side 64 and in contact with the major face 38 of the backing construction web 24 and a second portion is within the channel 62; and 3) remains in simultaneous contact with at least one of the strips 60 and the major face 38 for a dwell period. Optionally, the backing construction web 24 moves relative to the distribution tool 50 and/or the distribution tool 50 moves relative to the backing construction web 24 during part, or an entirety, of the dwell period. In other embodiments, the backing construction web 24 and the distribution tool 50 do not move relative to one another as the abrasive particles 36 are being applied (e.g., the backing construction web 24 and the distribution tool 50 both remain stationary, or the backing construction web 24 and the distribution tool 50 move in tandem). Less than 100% of the abrasive particles 36 included with the supply 100 as loaded onto the distribution tool 50 undergo the particle orientation sequence in some embodiments.

Figure 4:
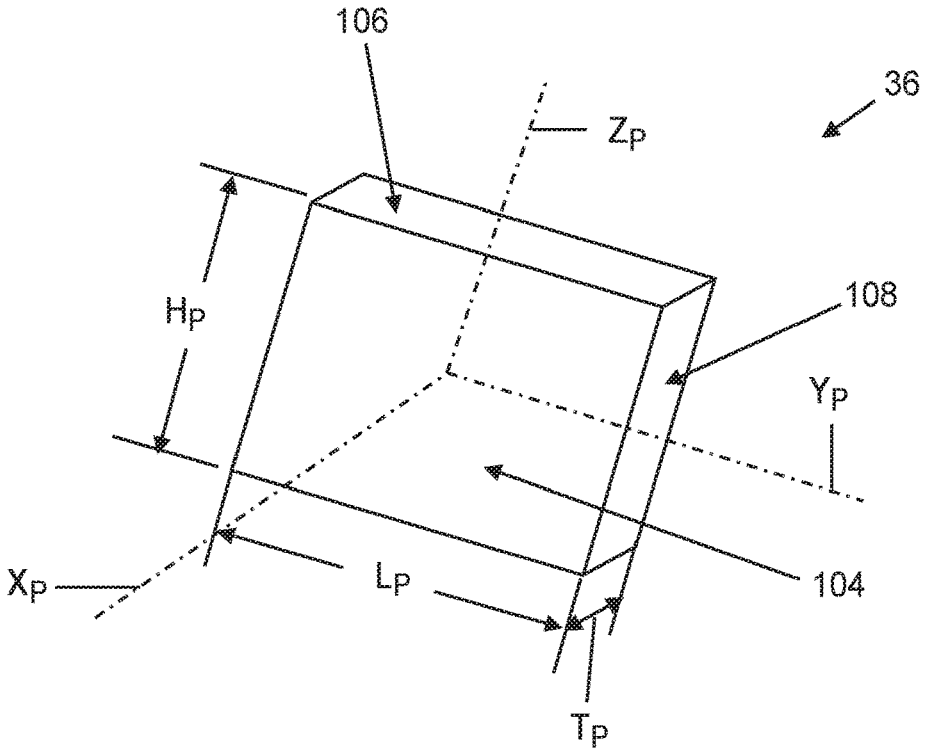
FIG. 4 is a perspective view of an abrasive particle useful with the tools, systems, and methods of the present disclosure.

The gross biased orientation and alignment provided by distribution tools of the present disclosure can be characterized by reference to major axes and dimensions of the abrasive particle. FIG. 4 is a generic, non-limiting example of the abrasive particle 36, the exterior shape of which defines a particle maximum length, maximum height and maximum thickness $L_P$, $H_P$, $T_P$ dimensions that represent maximum dimensions of the abrasive particles 36 in three orthogonal planes. The particle maximum length, height and thickness $L_P$, $H_P$, $T_P$ are a function of a shape of the abrasive particle 36, and the shape may or may not be uniform. The present disclosure is in no way limited to any particular abrasive particle shape, dimensions, type, etc., and several exemplary abrasive particles useful with the present disclosure are described in greater detail below. However, with some shapes, the "height" of the abrasive particle 36 may more conventionally be referred to as a "width". The abrasive particle 36 is shown in FIG. 4 as arbitrarily having a rectangular prism shape, with opposing major faces 104 (one of which is visible), opposing major side faces 106 (one of which is visible), and opposing minor side faces 108 (one of which is visible). Regardless of an exact shape, any abrasive particle can be described as providing the particle maximum length $L_P$ as the largest dimension in any one plane, the particle maximum height $H_P$ as being the largest dimension in any plane orthogonal to the plane of the maximum length $L_P$, and the maximum thickness $T_P$ as being the largest dimension in a third plane orthogonal to the planes of the maximum length $L_P$ and height $H_P$. The particle maximum length $L_P$ is greater than or equal to the particle maximum height $H_P$, and the particle maximum height $H_P$ is greater than or equal to the particle maximum thickness $T_P$. Abrasive particles useful with the present disclosure can have circular geometries such that the terms "length", "height" or "thickness" are inclusive of diameter.

A shape of the abrasive particle 36 defines a centroid at which particle $X_P$, $Y_P$ and $Z_P$ axes can be defined (the particle $X_P$, $Y_P$ and $Z_P$ axes are orthogonal relative to one another). With the conventions of FIG. 4, the particle $Z_P$ axis is parallel with the maximum height $H_P$, the $Y_P$ axis is parallel with the maximum length $L_P$, and the $X_P$ axis is parallel with the maximum thickness $T_P$. As a point of reference, the particle $X_P$, $Y_P$, $Z_P$ axes are identified for the abrasive particle 36 as a standalone object independent of the backing construction web 24 (FIG. 3A); once applied to the backing construction web 24, a "z-axis rotation orientation" of the abrasive particle 36 is defined by the particle's angular rotation about a z-axis passing through the particle and through the backing to which the particle is attached at a 90 degree angle to the backing.

Figure 5A:
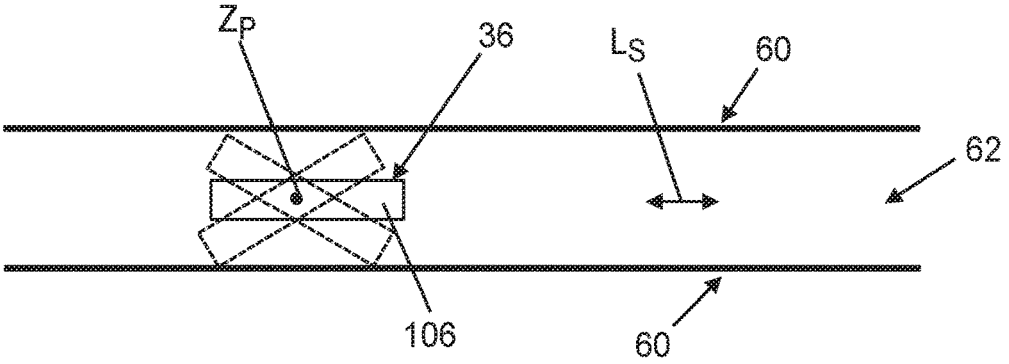
FIG. 5A is a top view of a portion of the distribution tool of FIG. 2A interacting with the abrasive particle of FIG. 4.
Figure 5B:
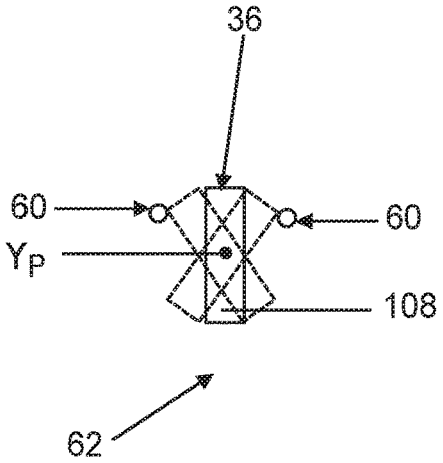
FIG. 5B is an end view of the arrangement of FIG. 5A.
Figure 5C:
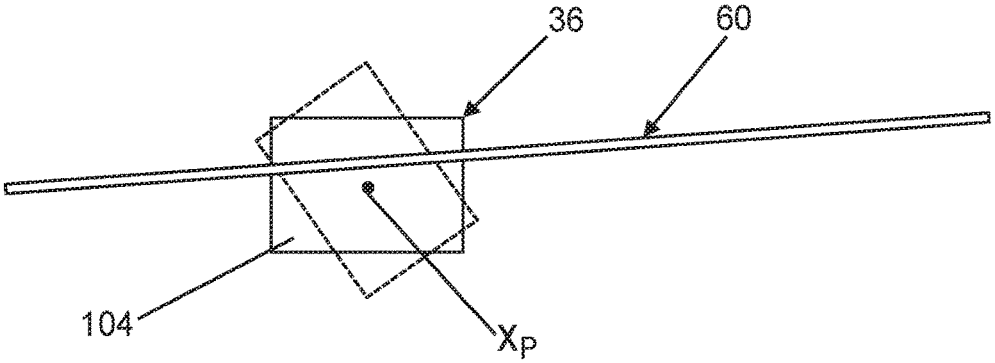
FIG. 5C is a side view of the arrangement of FIG. 5A.

The gross biased orientation effected by the distribution tools of the present disclosure entail dictating or limiting a spatial arrangement of the abrasive particle to a range of rotational orientations about the particle $Z_P$ axis and to a range of rotational orientations about the particle $Y_P$ axis; the gross biased orientation does not dictate or limit a rotational orientation about the particle $X_P$ axis. For example, FIG. 5A provides a top view of the abrasive particle 36 within one of the channels 62. The opposing strips 60 limit a rotational orientation of the abrasive particle 36 about the $Z_P$ axis to a range reflected by phantom representations of the abrasive particle 36. Similarly, FIG. 5B is an end view of the abrasive particle 36 within the channel 62. Gross biased orientation includes the opposing strips 60 limiting a rotational orientation of the abrasive particle 36 about the $Y_P$ axis within a range reflected by phantom representations of the abrasive particle 36. Finally, FIG. 5C is a side view of the abrasive particle 36 within the channel 62 (referenced generally) relative to one of the strips 60 (it being understood that the opposing strand of the channel 62 is not shown). The abrasive particle 36 can freely assume any rotational orientation about the $X_P$ axis (one possible rotational orientation about the $X_P$ axis is represented in phantom in FIG. 5C).

Figure 6A:
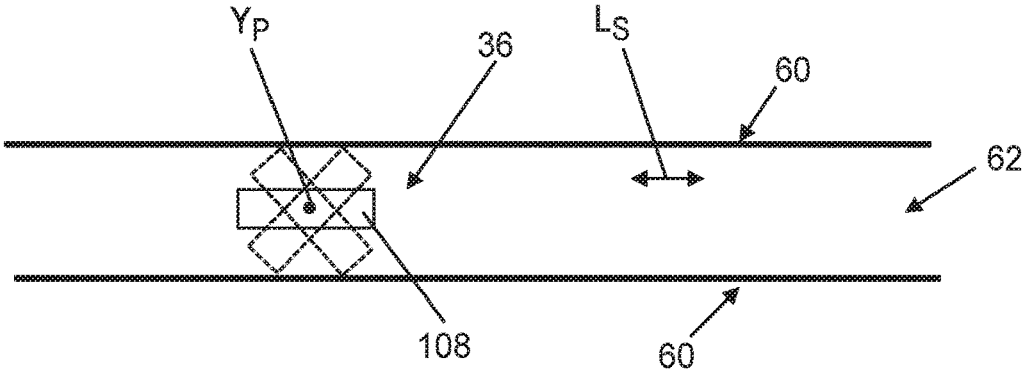
FIGS. 6A-6C illustrate the arrangement of FIGS. 5A-5C with the abrasive particle in a different orientation.
Figure 6B:
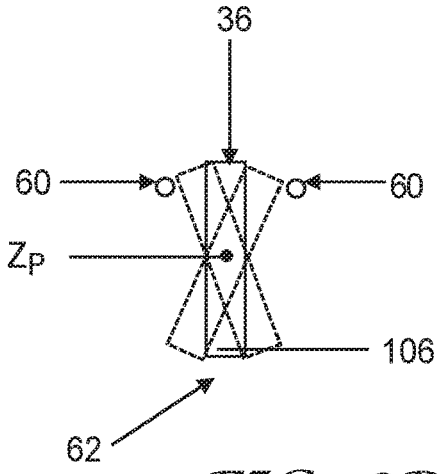
Figure 6C:
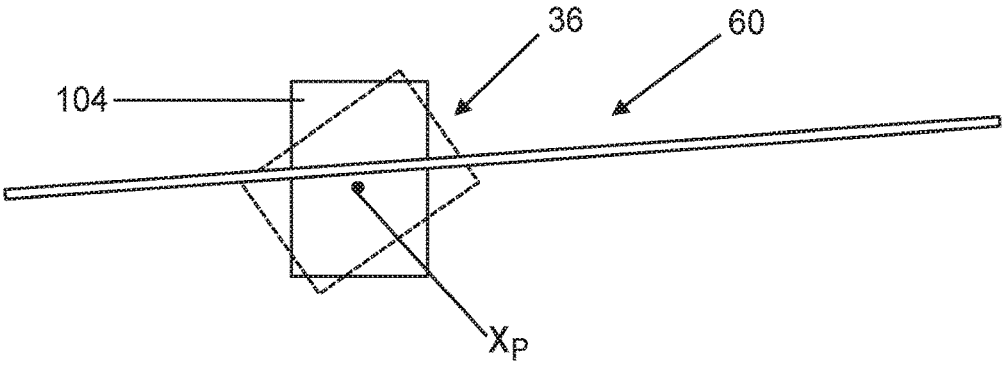

Depending upon the dimensions of the channel 62 and of the abrasive particle 36, the abrasive particle 36 may be able to "fit" within the channel 62 such that the particle $Y_P$ and $Z_P$ axes are rotated 90 degrees from the representations of FIGS. 5A and 5B in which the abrasive particle 36 is randomly arranged with the major side faces 106 parallel with the channel length $L_C$. FIGS. 6A-6C is another possible arrangement in which the minor side faces 108 are parallel with the channel length $L_C$. Once again, a gross biased orientation is achieved in which the abrasive particle 36 is limited to a range of orientations about the particle's $Y_P$ and $Z_P$ axes; the abrasive particle 36 can assume any rotational orientation about the particle $X_P$ axis.

With the above general explanations in mind and with reference between FIGS. 2A-2C and 4, it will be recalled that arrangement of the strips 60 and dimensions of the channels 62 are selected as a function of expected geometry or dimensions of the abrasive particles 36 to be processed. In more general terms, the arrangement and dimensions of the strips 60 and the channels 62 are selected based upon the particle maximum length $L_P$, maximum height $H_P$, and maximum thickness $T_P$ of the abrasive particles to be processed (it being understood that a bulk supply of a particular abrasive particle will purport to contain identically sized and shaped abrasive particles; invariably, however, individual ones of the abrasive particles within the bulk supply will have dimensions that slightly vary from one another within an accepted tolerances; thus, when selecting arrangement and dimensions for the strips 60 and the channels 62 for distributing the abrasive particles of the bulk supply as described in the present disclosure, the "dimensions" of any one abrasive particle of the bulk supply can be with reference to nominal dimension of the bulk supply).

Arrangement and dimensions of the strips 60 and the channels 62 are generally configured such that the channel width $W_C$ is less than at least the abrasive particle maximum length $L_P$, and optionally less than the abrasive particle maximum height $H_P$, dictating that the abrasive particle 36 must achieve a gross biased orientation before entering and passing through one of the channels 62, with the strips 60 further serving to support the abrasive particle 36 in the biased orientation as described below. While the channel width $W_C$ can closely approximate the maximum thickness $T_P$ so as to dictate a more precise particle $Z_P$ axis and $Y_P$ axis rotational orientation of the applied abrasive particles 36 (i.e., as the channel width $W_C$ approaches the maximum thickness $T_P$, the range of possible $Z_P$ axis and $Y_P$ axis rotational orientations the abrasive particle 36 can assume and still "fit" in the channel 62 is reduced), in some embodiments, the channel width $W_C$ is greater than the maximum thickness $T_P$ for enhanced throughput time (i.e., by providing a larger channel width $W_C$, abrasive particles 36 can randomly assume a larger range of $Z_P$ axis and $Y_P$ axis rotational orientations and still enter/pass through one of the channels 62, thereby making it "easier" for an individual abrasive particle 36 to obtain an appropriate spatial orientation thus improving the mass flow rate of the abrasive particles 36 through the distribution tool 50), approaching, but not exceeding, the particle maximum length and maximum height $L_P$, $H_P$. For example, the channel width $W_C$ can be at least 125%, alternatively at least 150%, of the particle maximum thickness $T_P$. Alternatively or in addition, the channel width $W_C$ can be 50-75% of the maximum height $H_P$ (so long as the calculated value is greater than the maximum thickness $T_P$). In yet other embodiments, the selected channel width $W_C$ is a non-integer factor of the maximum thickness $T_P$ (i.e., the channel width $W_C$ is not equal to the maximum thickness $T_P$, $2T_P$, $3T_P$, etc.) to avoid clogging (e.g., were the channel width $W_C$ to be equal to two times the maximum thickness $T_P$, two abrasive particles 36 could become aligned side-by-side each other and then collectively become lodged to the opposing strips 60 of one of the channels 62).

Figure 2C:
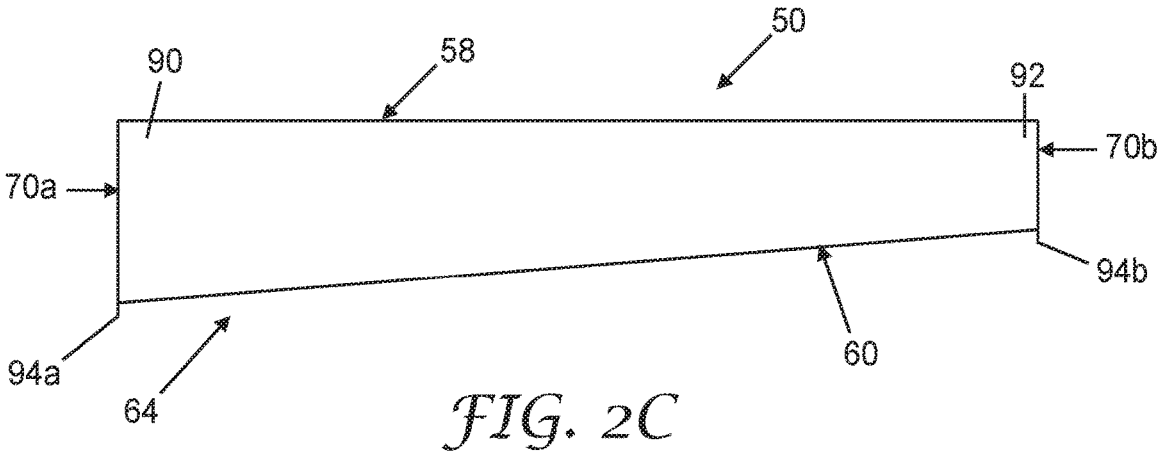
FIG. 2C is a side view of the tool of FIG. 2A.
Figure 7:
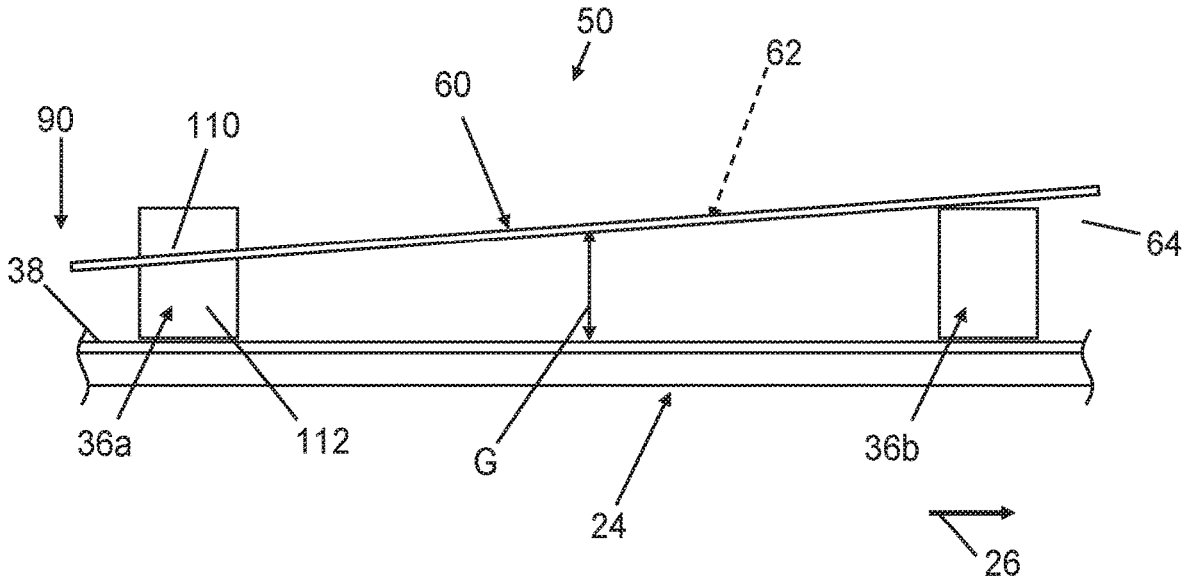
FIG. 7 is an enlarged side view of the distribution tool of FIG. 2A interacting with the abrasive particle of FIG. 4 as part of a system for manufacturing abrasive articles.

Dimensions of the abrasive particles 36 can also be utilized to determine a size of the gap G between the lower side 64 of the distribution tool 50 and the backing construction web 24 as shown in FIG. 7. In particular, the gap G is sized so as to ensure that once in contact with the backing construction web 24 at or adjacent the entrance side 90, a portion of the abrasive particle 36 remains "within" the corresponding channel 62 (referenced generally in FIG. 7, it being understood that in the view of FIG. 7, the channel 62 is "hidden" behind the strip 60 otherwise visible in the illustration), supported by at least one of the corresponding strips 60. In some embodiments, and with cross-reference between FIGS. 4 and 7 at the entrance side 90, the size of the gap G is 10-90% of the particle maximum height HP, alternatively 25-75% of the particle maximum height $H_P$. For example, in the illustration of FIG. 7, a first abrasive particle 36*a* has achieved the gross biased orientation dictated by the distribution tool 50, fallen along one of the channels 62, and become arranged on the backing construction web 24 near the entrance side 90. Because a size of the gap G at the entrance side 90 is less that the particle maximum height $H_P$, a first portion 110 of the abrasive particle 36*a* remains within the channel 62 or "above" the strips 60, and a second portion 112 is beyond the lower side 64. Thus, the abrasive particle 36 is supported by at least one of the strips 60 (i.e., the first portion 110 contacts at least one of the strips 60) as the abrasive particle 36*a* traverses along the distribution tool 50 with movement of the backing construction web 24 in the machine direction 26. As the applied abrasive particles approach the exit side 92 (e.g., the second abrasive particle 36*b* in FIG. 7), the abrasive particle 36*b* no longer contacts the strip(s) 60 due to the increasing size of the gap G (in the machine direction 26). The applied abrasive particle 36*b* freely passes under the second end wall 70*b* (FIG. 2C).

Figure 8A:
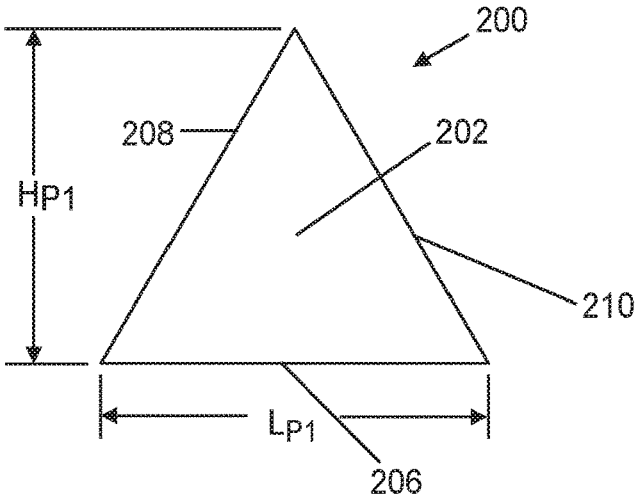
FIG. 8A is a top plan view of another abrasive particle useful with the tools, systems, and methods of the present disclosure.
Figure 8B:
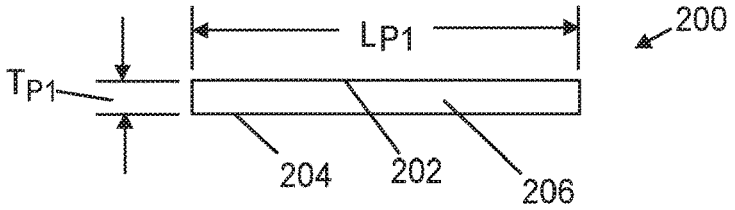
FIG. 8B is an end view of the abrasive particle of FIG. 8A.
Figure 8C:
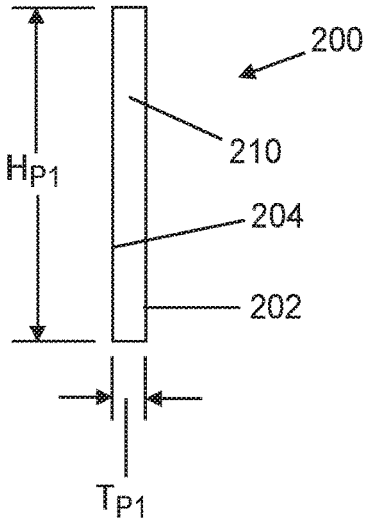
FIG. 8C is a side view of the abrasive particle of FIG. 8A.

The above criteria for construction of the distribution tools of the present disclosure, and in particular arrangement and dimensions of the strips 60, the channels 62 and the gap G, can be applied to a plethora of different abrasive particle constructions. For example, particle maximum length, height and thickness $L_{P1}$, $H_{P1}$, $T_{P1}$ are designated for one exemplary abrasive particle 200 shape in FIGS. 8A-8C. A shape of the abrasive particle 200 is akin to an equilateral triangular prism, with FIG. 8A providing a top view, FIG. 8B an end view, and FIG. 8C a side view. Due to the equilateral triangular prism shape, the maximum length $L_{P1}$ and the maximum height $H_{P1}$ are uniform across a thickness of the abrasive particle 200 (i.e., the abrasive particle 200 can be viewed as defining opposing major faces 202, 204; the maximum length and height $L_{P1}$, $H_{P1}$ exist at both of the faces 202, 204). The maximum height $H_{P1}$ is known or can be calculated, and is less than the maximum length $L_{P1}$. The maximum thickness $T_{P1}$ is less than the maximum length and height $L_{P1}$, $H_{P1}$. Side faces 206-210 of the abrasive particle 200 have an identical shape and size, and are perpendicular to the major faces 202, 204.

Figure 9A:
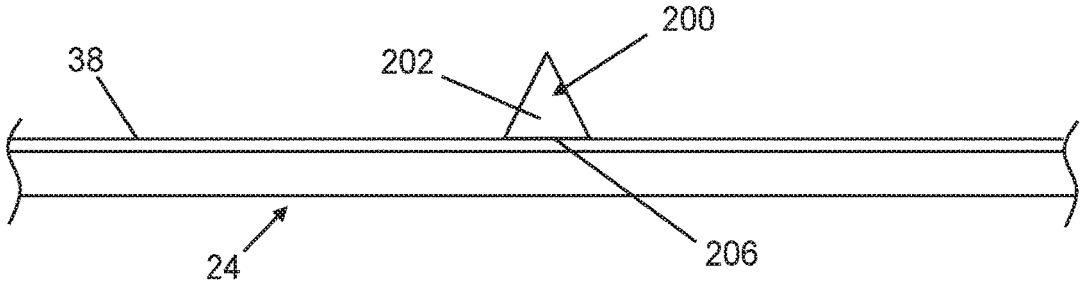
FIG. 9A is a side view of the abrasive particle of FIG. 8A attached to a backing.

An abrasive article manufacturer may prefer that the abrasive particle 200 be applied to and retained at the major face 38 of the backing construction web 24 in an "upright" position as generally reflected by FIG. 9A (i.e., one of the side faces 206-210 of the abrasive particle 200 bears against or is embedded into the backing construction major face 38, as compared to a non-upright orientation in which one of the particle major faces 202, 204 is at the backing construction major face 38). With reference to FIGS. 2A-2C and 8A-8C, the distribution tool 50 can be configured to grossly bias the abrasive particle 200 to the desired upright position by forming the channel width $W_C$ to be less than the particle maximum length and height $L_{P1}$, $H_{P1}$, and greater than the maximum thickness $T_{P1}$, commensurate with the descriptions above.

Figure 9B:
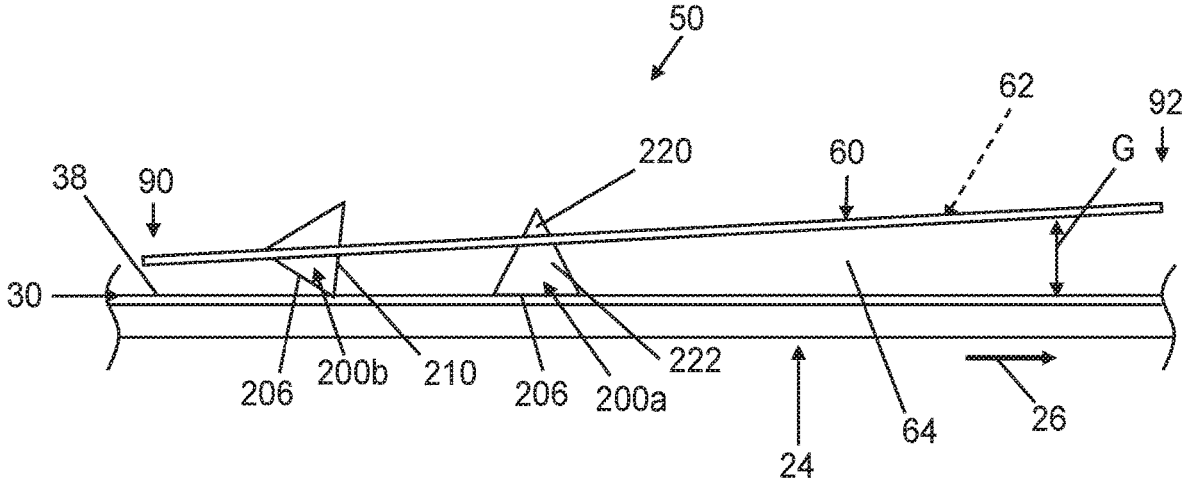
FIG. 9B is a side view of the distribution tool of FIG. 2A interacting with the abrasive particle of FIG. 8A as part of a system for manufacturing abrasive articles.

Dimensions of the abrasive particles 200 can also be utilized to determine a size of the gap G between the lower side 64 of the distribution tool 50 and the backing construction web 24 as shown in FIG. 9B. In particular, the gap G is sized so as to ensure that once in contact with the backing construction web 24 near the entrance side 90, a portion of the abrasive particle 200 remains "within" the corresponding channel 62 (referenced generally in FIG. 9B), supported by at least one of the corresponding strips 60. In some embodiments, and with cross-reference between FIGS. 8A and 9B, the size of the gap G at the entrance side is 25-75% of the particle maximum height $H_{P1}$. For example, a first abrasive particle 200*a* is identified in FIG. 9B. The first abrasive particle 200*a* has achieved the gross biased orientation dictated by the distribution tool 50, fallen along one of the channels 62, and become arranged on the backing construction web 24 (i.e., the first side face 206 bears on or in the major face 38). Because the size of the gap G relative to a location of the abrasive particle 200*a* is less that the particle maximum height $H_{P1}$, a first portion 220 of the abrasive particle 200*a* remains within the channel 62, and a second portion 222 is beyond the lower side 64. Thus, the abrasive particle 200*a* is supported by at least one of the strips 60 (i.e., the first portion 220 contacts at least one of the strips 60) as the abrasive particle 200*a* traverses along the distribution tool 50 with movement of the backing construction web 24 in the machine direction 26. As the abrasive particle 200*a* approaches the exit side 92, contact with the strip(s) 60 no longer occurs and the abrasive particle 200*a* freely passes under the second end wall 70*b* (FIG. 2C).

Figure 9C:
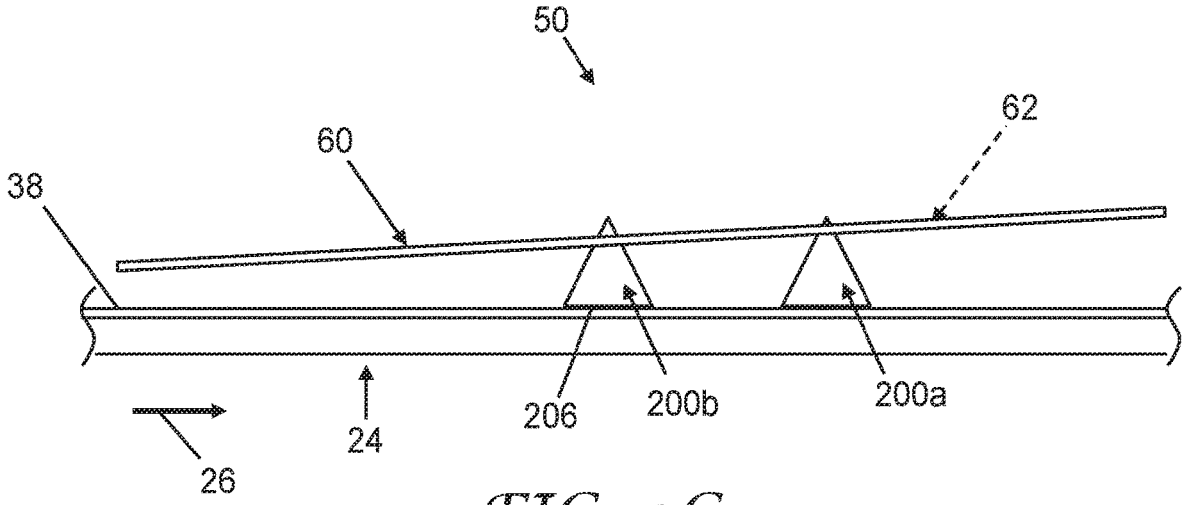
FIG. 9C is the arrangement of FIG. 9B at a later point in time.
Figure 9D:
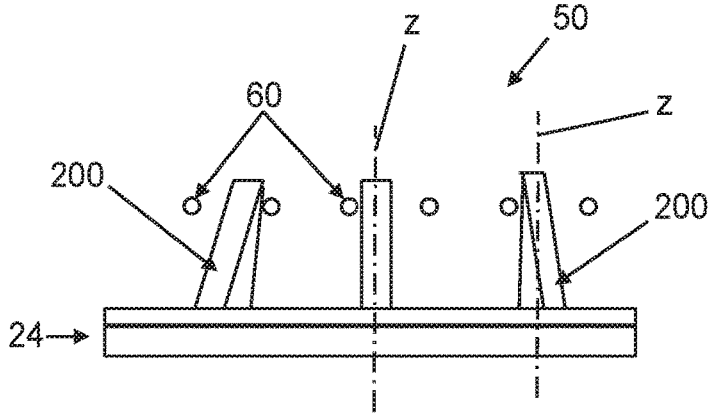
FIG. 9D is an end view of the arrangement of FIG. 9B.

FIG. 9B further reflects that as the abrasive particles 200 initially drop or fall along one of the channels 62, rotational orientation about the particle $X_P$ axis (FIG. 4) is effectively unconstrained, such that the abrasive particle 200 can initially contact the backing construction web 24 at a wide range of particle $X_P$ axis rotational orientations. For example, a second abrasive particle 200*b* is identified in FIG. 9B as initially contacting the backing construction web 24 at a skewed rotational orientation (i.e., none of the side faces 206-210 are parallel with the major face 38). Once in contact with the backing construction web 24, the abrasive particle 200*b* will naturally seek a stable orientation as it traverses the distribution tool 50 while being pulled along by the backing construction web 24 in the machine direction 26. This is a "base down" orientation in typically weights of the make coating 30. FIG. 9C represents a later point in time; with movement of the backing construction web 24, the abrasive particle 200*b* has now naturally attained a stable orientation in which the side face 206 is against or in the major face 38. Commensurate with the above descriptions, in this self-adjusted orientation, a portion of the abrasive particle 200*b* remains within the channel 62 (referenced generally), supported by at least one of the strips 60. Finally, the end view of FIG. 9D reflects that the gross biased orientation effectuated by the distribution tool 50 limits the z-axis rotational orientation (i.e., the applied particle's 200 angular rotation about a z-axis passing through the particle 200 and through the backing 24 to which the particle 36 is attached at a 90 degree angle to the backing 24) exhibited by each of the attached abrasive particles 200 to a prescribed range, although the z-axis rotational orientations will not be identical for all of the abrasive particles 200.

Figure 10A:
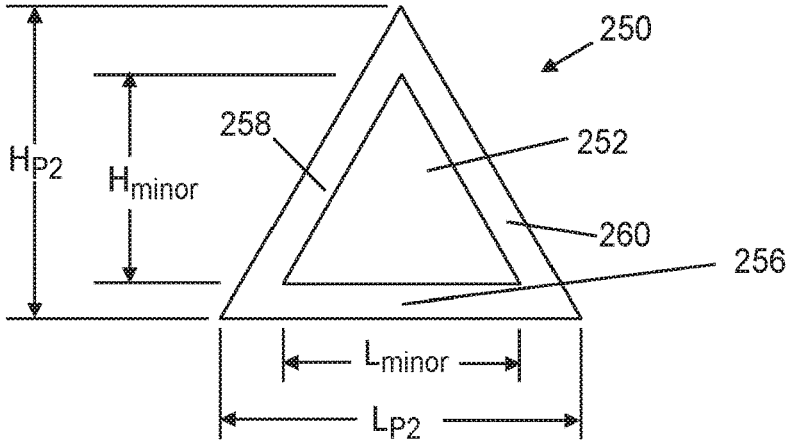
FIG. 10A is a top plan view of another abrasive particle useful with the tools, systems, and methods of the present disclosure.
Figure 10B:
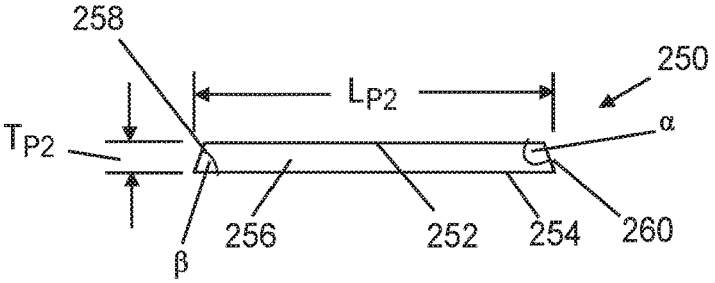
FIG. 10B is an end view of the abrasive particle of FIG. 10A.
Figure 10C:
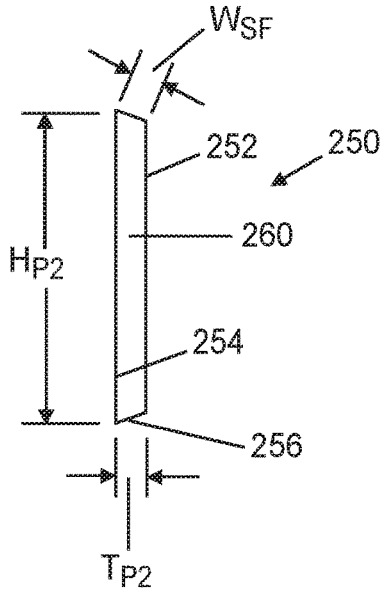
FIG. 10C is a side view of the abrasive particle of FIG. 10A.

A number of other abrasive particle shapes are useful with the distribution tools, systems and methods of the present disclosure. For example, the particle maximum length, height and thickness $L_{P2}$, $H_{P2}$, $T_{P2}$ are designated for another exemplary abrasive particle 250 shape in FIGS. 10A-10C. The shape of the abrasive particle 250 is akin to an equilateral triangular tapered prism in which the particle maximum length $L_{P2}$ is greater than the particle maximum height $H_{P2}$. The tapered geometry across the thickness dictates that dimensions of the abrasive particle 250 at a first major face 252 differ from those at a second, opposing major face 254. As generally reflected by the views, the maximum length $L_{P2}$ and the maximum height $H_{P2}$ are found at the second major face 254; while the first major face 252 has length and height dimensions (labeled as $L_{minor}$, $H_{minor}$), the length and height of the abrasive particle 250 at the first major face 252 are less than those of the second major face 254, with the maximum length and height dimensions $L_{P2}$, $H_{P2}$ existing or being measured at the second major face 254. The maximum thickness $T_{P2}$ is less than the maximum length and height $L_{P2}$, $H_{P2}$. Side faces 256-260 of the abrasive particle 250 have an identical shape and size, and can be characterized as "sloping", defining a draft angle a relative to the first major face 252 and a base angle β relative to the second major face 254. For example, the abrasive particle 250 can assume any of the constructions described in US Publication No. 2010/0151196 entitled "Shaped Abrasive Particle With A Sloping Sidewall" the teachings of which are incorporated herein by reference.

Figure 11A:
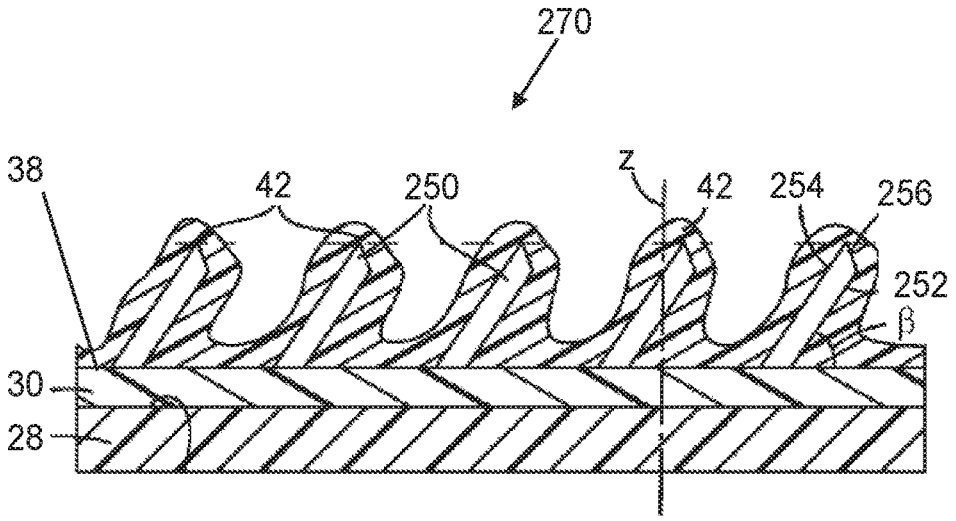
FIG. 11A is a cross-sectional view of an abrasive article including the abrasive particles of FIG. 10A.

An abrasive article manufacturer may prefer that the abrasive particle 250 be applied to and retained at the major face 38 of the backing construction web 24 in an "upright" position as generally reflected by an exemplary coated abrasive article 270 in FIG. 11A (i.e., one of the side faces 256-260 of each of the abrasive particles 250 bears against or is embedded into the backing construction major face 38, with the abrasive particle 250 having an overall "tipped" or "leaning" arrangements and covered with the size coat 42). With additional reference to FIGS. 2A-2C and 10A-10C, the distribution tool 50 can be configured to grossly bias the abrasive particles 250 to the desired upright, tilted orientation by forming the channel width $W_C$ to be less than the particle maximum length and height $L_{P2}$, $H_{P2}$, and greater than the maximum thickness $T_{P2}$ commensurate with the descriptions above. In some embodiments, the channel width $W_C$ is sufficiently large so that the abrasive particles 250 can freely assume the tipped or leaning arrangement, such as by being 25%-75% of the particle maximum height $H_{P2}$.

In other embodiments, the channel width $W_C$ can be more precisely calculated as based on geometry of the abrasive particle 250. With constructions in which the abrasive particle 250 has a uniform equilateral triangular tapered prism shape, the side edge dimensions of the first and second major faces 252, 254 can be measured or are known (and serve as the "length" dimension), as are the draft angle α and the base angle β. Due to the equilateral triangular shape and the known/measured length dimension, the height $H_{minor}$ of the first major face 252 can be calculated as:

$$H_{minor}=3^{1/2}/2\times L_{minor}$$

Alternatively, the height $H_{minor}$ of the first major face 252 can be measured. With the particle thickness $T_{P2}$ being known or measured, a width $W_{SF}$ of any side face 256-260 is then calculated as:

$$W_{SF}=T_{P2}/\sin\beta$$

Figure 11B:
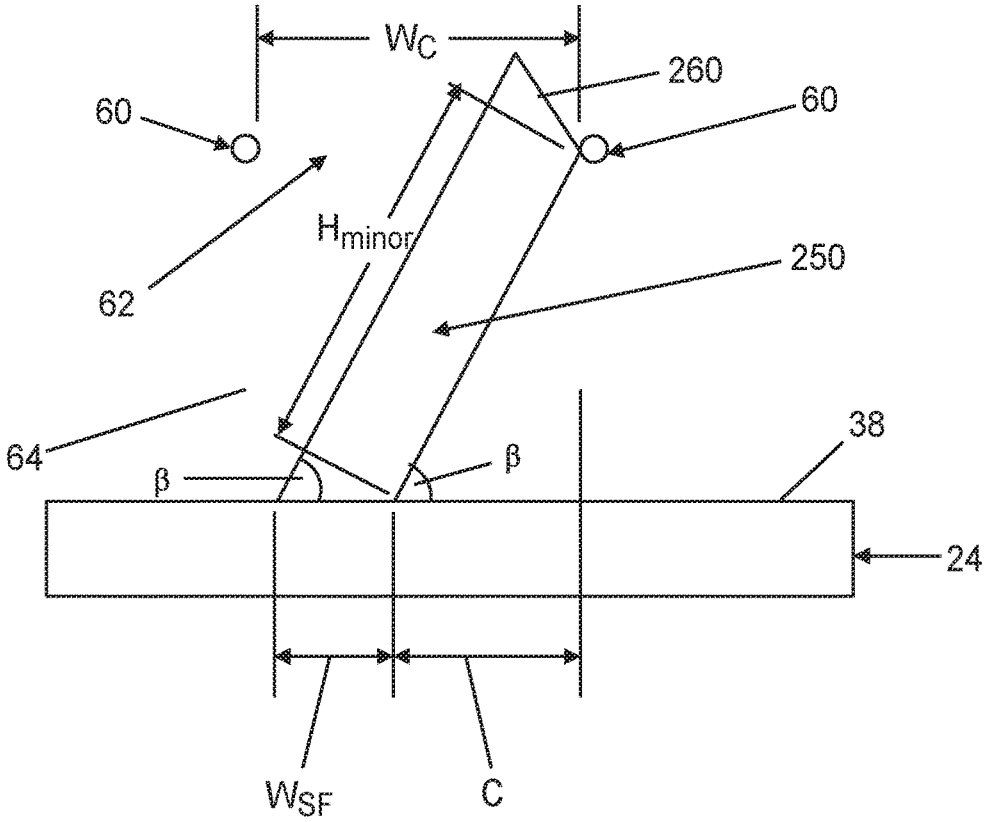
FIG. 11B is an enlarged end view of a portion of the distribution tool of FIG. 2A in applying the abrasive particle of FIG. 10A to a backing.

With reference to FIG. 11B, the channel width $W_C$ can then be determined as a function of the side face width $W_{SF}$. In particular, in order to accommodate the footprint of the abrasive particle 250 in the tipped orientation (in which one of the side faces 256-260 is substantially parallel with the major face 38 of the backing construction web 24 and thus substantially perpendicular to the plane of each of the strands 60), the channel width $W_C$ should be equal to or greater than the side face width $W_{SF}$ plus a clearance dimension (designated as "C" in FIG. 11B). The clearance dimension C can be calculated as:

$$C=H_{minor}\times\cos\beta$$

Thus, the channel width $W_C$ can be calculated as:

$$W_C\geq W_{SF}+C, \text{ or}$$

$$W_C\geq T_{P2}/\sin\beta+(H_{minor}\times\cos\beta)$$

Dimensions of the abrasive particles 250 can also be utilized to determine a variable size of the gap G (FIG. 7)

between the lower side 64 of the distribution tool 50 and the backing construction web 24 as described above.

Figure 12A:
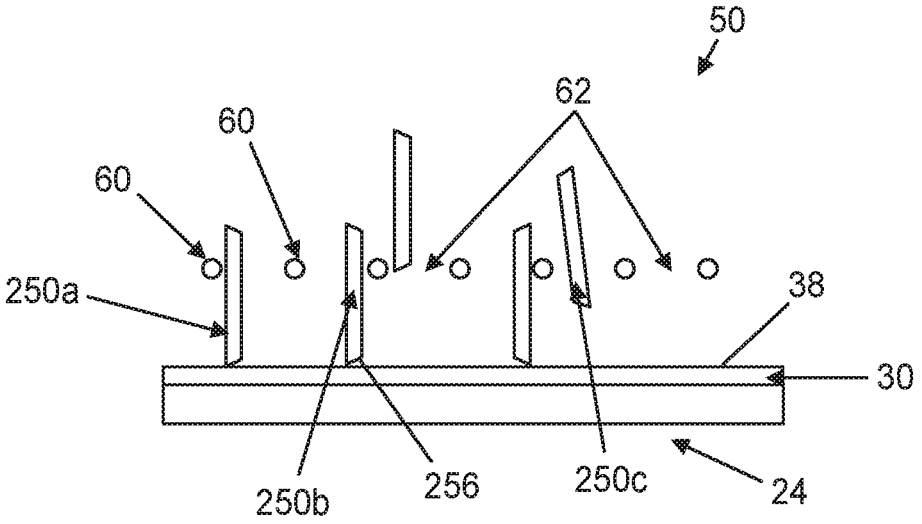
FIGS. 12A and 12B are end views of the distribution tool of FIG. 2A interacting with the abrasive particles of FIG. 10A as part of a system for manufacturing abrasive articles.
Figure 12B:
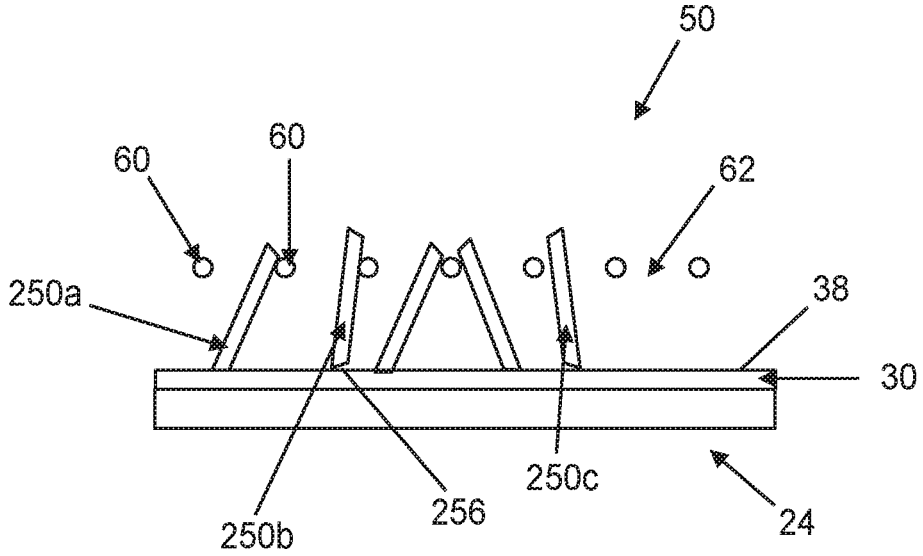

Use of the distribution tool 50 in applying a plurality of the abrasive particles 250 is highly akin to the descriptions above. In some embodiments, the distribution tool 50 is configured and arranged so that regardless of the particle $Y_P$, $Z_P$ axes (FIG. 4) rotational orientation of the abrasive particle 250 as it passes along the corresponding channel 62, the abrasive particle 250 is permitted to self-revert toward the "tilted" orientation, with one or more of the strands 60 supporting the abrasive particle in this tilted orientation. For example, the view of FIG. 12A represents various ones of the abrasive particles 250 falling through various ones of the channels 62 at a first point in time. A first one of the abrasive particles 250*a* is shown has having contacted the major face 38 of the backing construction web 24 at a rotational orientation in which none of the side faces 256-260 are parallel with the major face 38. In other words, while the first abrasive particle 250*a* has attained the gross biased orientation referenced above sufficient for passing into and partially through the channel 62, the abrasive particle 250*a* is not in the desired tilted orientation. Once in contact with the backing construction web 24, the abrasive particle 250*a* becomes at least partially secured to the make coat 30; however, a surface tension of the make coat 30 and other parameters allow the abrasive particle 250*a* to naturally tip. FIG. 12B reflects this phenomena, illustrating the arrangement of FIG. 12A at a later point in time. More particularly, the abrasive particle 250*a* has self-reverted toward the desired "tipped" orientation, and is supported in this tipped arrangement via contact with one of the strips 60.

As a point of reference, as the abrasive particles 250 randomly fall through the corresponding strands 62, each one of the abrasive particles 250 will not necessarily be spatially located to achieve the final or complete tipped arrangement. For example, a second abrasive particle 250*b* is identified in FIGS. 12A and 12B. In the state of FIG. 12A, the second abrasive particle 250*b* is dropping through the channel in relatively close proximity to the strips 60. The second abrasive particle 250*b* contacts the major face 38 of the backing construction web 24 (FIG. 12A), and then self-tips to the arrangement of FIG. 12B. As shown, the second abrasive particle 250*b* comes into contact with the strips 60 prior to achieving the fully tipped arrangement (i.e., the side face 256 is not parallel with the major face 38). However, upon later exiting the distribution tool 50 (i.e., the second abrasive article 250*b* is no longer in contact with any of the strips 60), the make coat 30 remains sufficiently fluid such that the second abrasive particle 250*b* is likely to self-transition to the desired tipped arrangement.

FIGS. 12A and 12B also illustrate that with the gross biased orientations dictated by the distribution tools of the present disclosure, the abrasive particles 250 can randomly assume different spatial arrangements within the prescribed particle $Y_P$, $Z_P$ axes ranges. For example, a third abrasive article 250*c* is identified and is shown as being spatially arranged approximately 180 degrees (about the particle $Z_P$ axis) as compared to the first and second abrasive particles 250*a*, 250*b*.

Figure 13A:
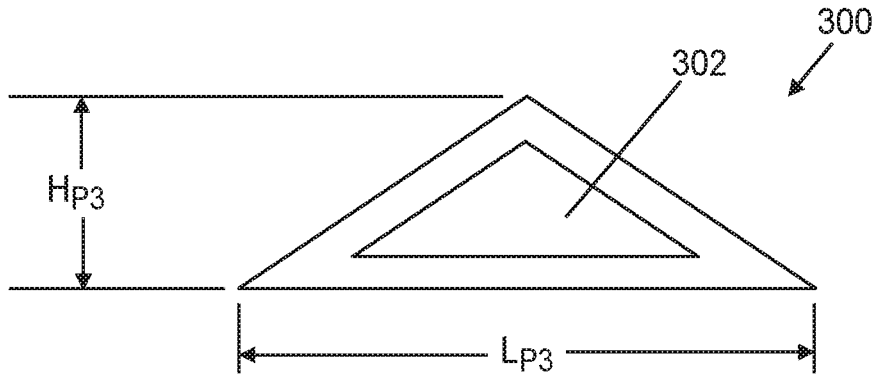
FIG. 13A is a top plan view of another abrasive particle useful with the tools, systems, and methods of the present disclosure.
Figure 13B:
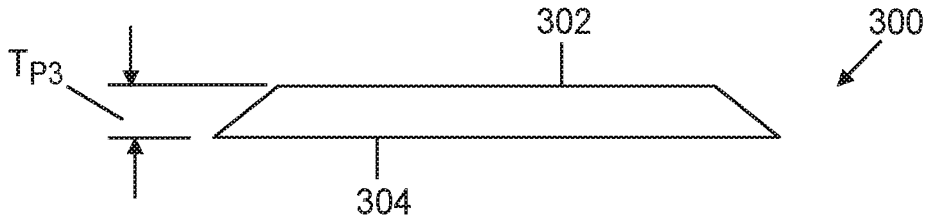
FIG. 13B is an end view of the abrasive particle of FIG. 13A.
Figure 13C:
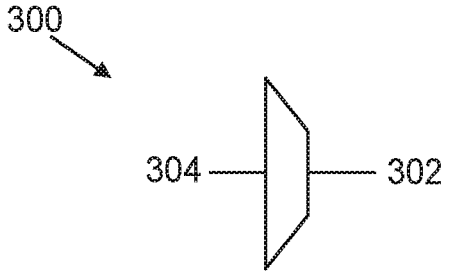
FIG. 13C is a side view of the abrasive particle of FIG. 13A.
Figure 14A:
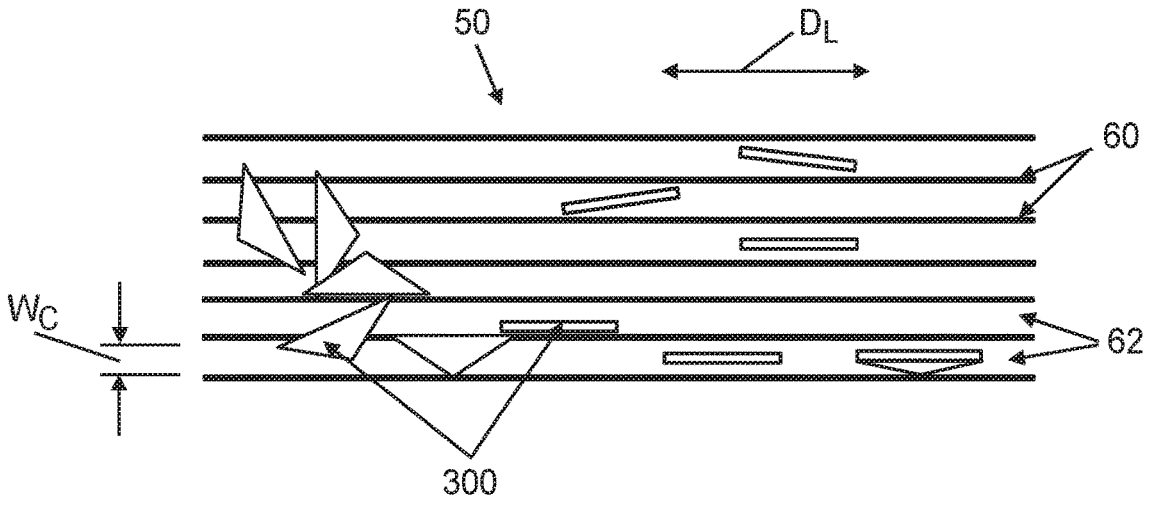
FIGS. 14A and 14B are top views of distribution tools in accordance with principles of the present disclosure interfacing with the abrasive particles of FIG. 13A.
Figure 14B:
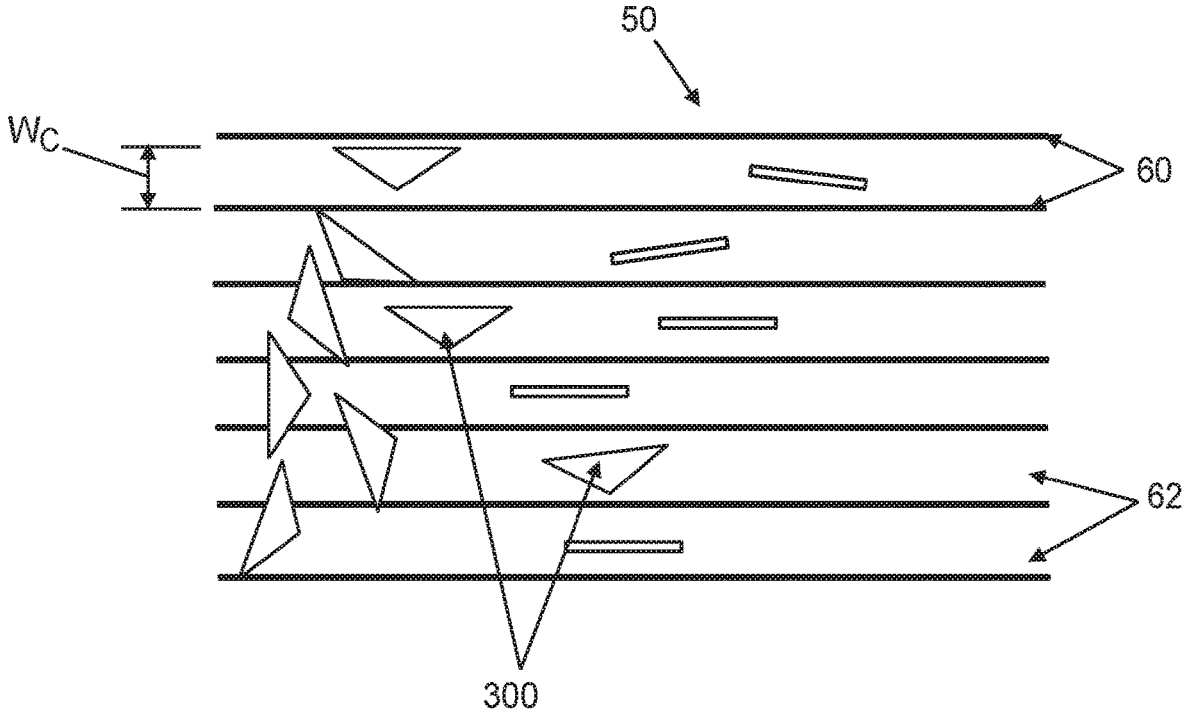

A number of other abrasive particle shapes are equally useful with the present disclosure. By way of further non-limiting example, the particle maximum length, height and thickness $L_{P3}$, $H_{P3}$, $T_{P3}$ are designated for another exemplary abrasive particle 300 shape in FIGS. 13A-13C. The shape of the abrasive particle 300 is akin to an isosceles triangular tapered prism. The maximum length $L_{P3}$ is greater than the maximum height $H_{P3}$. The tapering geometry dictates that the length and height at a first major face 302 differ from an opposing second major face 304, with the maximum length and height $L_{P3}$, $H_{P3}$ being found or measured at the second major face 304 as described above. The maximum thickness $T_{P3}$ is less than the maximum length and height $L_{P3}$, $H_{P3}$. With additional reference to FIGS. 2A-2C and commensurate with the above descriptions, the distribution tool 50 can be configured such that the channel width $W_C$ is less than the particle maximum length $L_{P3}$, optionally less than the particle maximum height $H_{P3}$, but is greater than the particle maximum thickness $T_{P3}$. For example, the view of FIG. 14A illustrates one construction in which the channel width $W_C$ is less than the maximum height $H_{P3}$ (and thus less than the maximum length $L_{P3}$). As a result, the abrasive particles 300 cannot enter any of the channels 62 whenever spatially arranged such that the maximum length $L_{P3}$ or the maximum height $H_{P3}$ is perpendicular to the length direction $D_L$. Alternatively, there may be circumstances where the abrasive article manufacturer is comfortable with a wider range of abrasive particle orientations. Thus, and as reflected by FIG. 14B, the channel width $W_C$ can be selected to be less than the particle maximum length $L_{P3}$ but greater than the particle maximum height $H_{P3}$, permitting the abrasive particles 300 to more readily attain a spatial orientation appropriate for entering one of the channels 62.

As evidenced by the above explanations, the distribution tools of the present disclosure are useful with a plethora of abrasive particle shapes, such as any precision shaped grain currently available or in the future developed. Non-limiting examples of other precision shaped grains or abrasive particles useful with the present disclosure include those described in U.S. Patent Application Publication No. 2009/0169816 entitled "Shaped, Fractured Abrasive Particle, Abrasive Article Using Same and Method of Making"; U.S. Patent Application Publication No. 2010/0146867 entitled "Shaped Abrasive Particles With Grooves"; U.S. Patent Application Publication No. 2010/0319269 entitled "Shaped Abrasive Particles With Low Roundness Factor"; U.S. Patent Application Publication No. 2012/0227333 entitled "Dual Tapered Shaped Abrasive Particles"; U.S. Patent Application Publication No. 2013/0040537 entitled "Ceramic Shaped Abrasive Particles, Methods of Making the Same, and Abrasive Articles Containing the Same"; and U.S. Patent Application Publication No. 2013/0125477 entitled "Intersecting Plate Shaped Abrasive Particles"; the entire teachings of each of which are incorporated herein by reference.

Figure 15A:
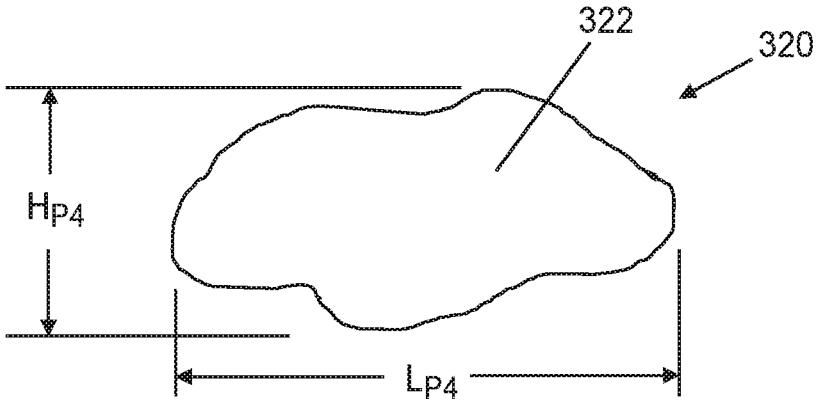
FIG. 15A is a top plan view of another abrasive particle useful with the tools, systems, and methods of the present disclosure.
Figure 15B:
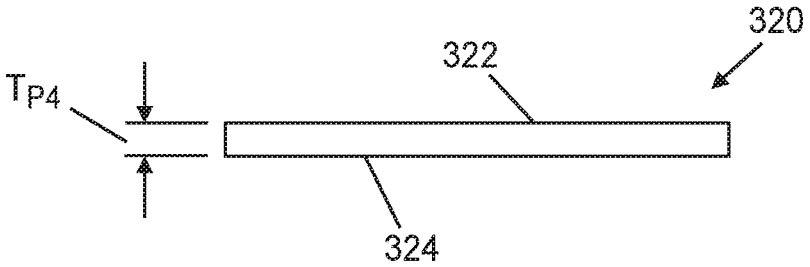
FIG. 15B is an end view of the abrasive particle of FIG. 15A.
Figure 15C:
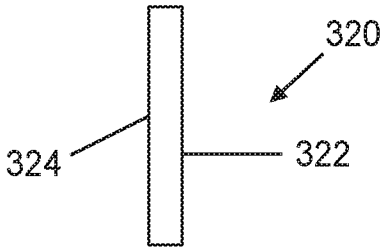
FIG. 15C is a side view of the abrasive particle of FIG. 15A.

In addition, the tools, systems and methods of the present disclosure are also useful with more abstract or complex abrasive particle shapes (e.g., shards). For example, the particle maximum length, height and thickness $L_{P4}$, $H_{P4}$, $T_{P4}$ are designated for another exemplary abrasive particle 320 shape in FIGS. 15A-15C. The shape of the abrasive particle 320 is akin to a complex prism in which opposing faces 322, 324 have a random, complex shape. The particle maximum length $L_{P4}$ is greater than the particle maximum height $H_{P4}$. The particle maximum thickness $T_{P4}$ is less than the particle maximum length and height $L_{P4}$, $H_{P4}$. With additional reference to FIGS. 2A-2C and commensurate with the above descriptions, the distribution tool 50 can be configured such that the channel width $W_C$ is less than the maximum length $L_{P4}$, optionally less than the maximum height $H_{P4}$, but is greater than the maximum thickness $T_{P4}$.

Regardless of shape, the tools, systems and methods of the present disclosure are useful with a wide range of abrasive particle materials. Exemplary useful abrasive particles include fused aluminum oxide based materials such as aluminum oxide, ceramic aluminum oxide (which may include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and blends thereof. The abrasive particles may be in the form of, for example, individual particles, agglomerates, abrasive composite particles, and mixtures thereof.

Returning to FIG. 1, apart from the distribution tool 50 (and other optional components of the distribution device 22) and use thereof, other features of the abrasive article manufacturing systems and methods of the present disclosure can assume a wide variety of forms as are known in the art.

For example, the backing 28 can be a flexible backing. Suitable flexible backings include polymeric films, metal foils, woven fabrics, knitted fabrics, paper, vulcanized fiber, nonwovens, foams, screens, laminates, and combinations thereof. The coated abrasive articles with a flexible backing may be in the form of sheets, discs, belts, pads, or rolls. In some embodiments, the backing 28 can be sufficiently flexible to allow the coated abrasive article to be formed into a loop to make an abrasive belt that can be run on suitable grinding equipment.

The make coat 30 and, where provided, the size coat 42 comprise a resinous adhesive. The resinous adhesive of the make coat 30 can be the same as or different from that of the size coat 42. Examples of resinous adhesives that are suitable for these coats include phenolic resins, epoxy resins, urea-formaldehyde resins, acrylate resins, aminoplast resins, melamine resins, acrylated epoxy resins, urethane resins and combinations thereof. In addition to the resinous adhesive, the make coat 30 or size coat 42, or both coats, may further comprise additives that are known in the art, such as, for example, fillers, grinding agents, wetting agents, surfactants, dyes, pigments, coupling agents, adhesion promoters, and combinations thereof. Examples of fillers include calcium carbonate, silica, talc, clay, calcium metasailicate, dolomite, aluminum sulfate and combinations thereof.

Figure 16:
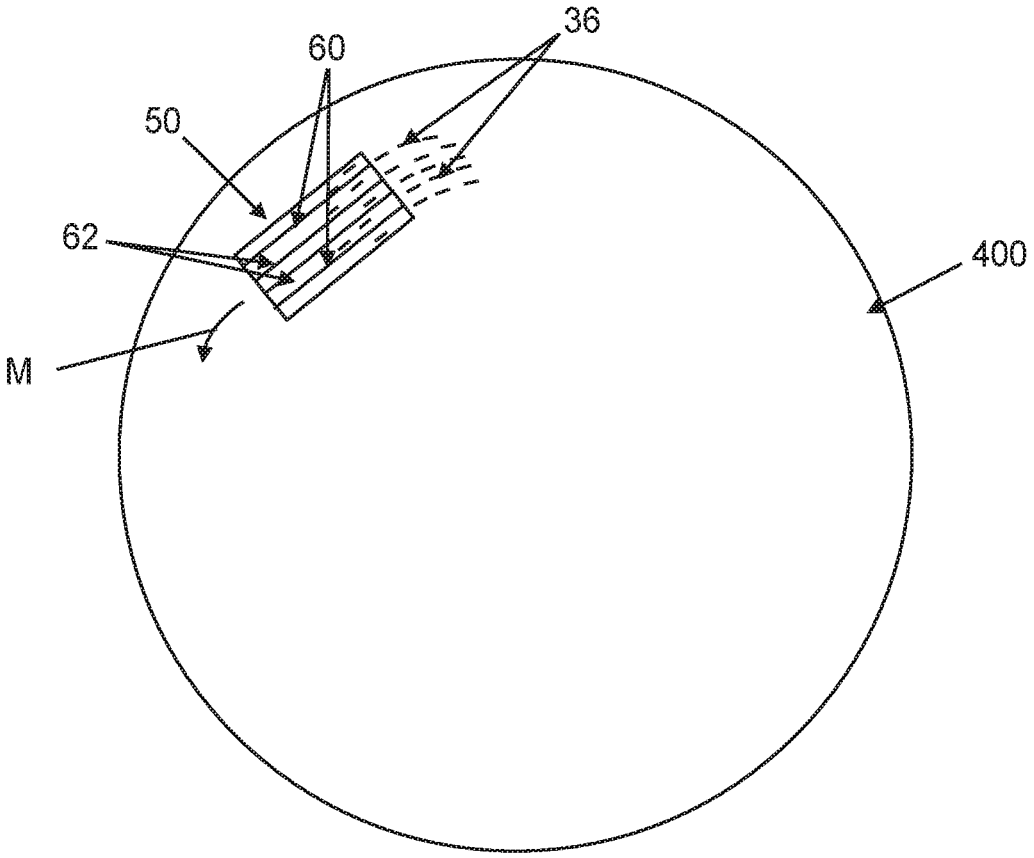
FIG. 16 is a simplified top plan view illustrating a portion of another method of manufacturing an abrasive article using a distribution tool in accordance with principles of the present disclosure.

The distribution tools of the present disclosure are equally useful with other abrasive article manufacturing systems and methods apart from those implicated by FIG. 1. For example, the distribution tools of the present disclosure can be utilized to apply abrasive particles at a grossly biased orientation that is other than downweb and/or onto backing web constructions that have disc or other non-linear shapes. With these and other alternative embodiments, the backing and the distribution tool do not move relative to one another as the abrasive particles are being applied (e.g., the backing construction web and the distribution tool both remain stationary, or the backing construction web and the distribution tool move in tandem). Another alternative embodiment in accordance with the present disclosure is represented by FIG. 16 in which the distribution tool 50 is utilized to apply the abrasive particles 36 to a backing web construction or backing 400. The backing 400 has a disc shape. The abrasive particles 36 are initially supplied to the distribution tool 50, and then applied to a surface of the backing 400 in a biased orientation upon passing through one of the channels 62 as described above. As the abrasive particles 36 are distributed on to the backing 400, the distribution tool 50 and the backing 400 can remain stationary relative to another; once, the abrasive particles 36 have been applied, the distribution tool 50 is incrementally moved (e.g., rotated) relative to the backing 400 in a direction represented by the arrow M (and/or vice-versa) until the distribution tool 40 is over a "new" area of the backing 400 for receiving additional ones of the abrasive particles 36. Alternatively, the distribution tool 50 can be sized and shaped such that as the abrasive particles 36 are being supplied to the distribution tool 50, the distribution tool 50 can be slowly moved (e.g., rotated) relative to the backing 400 in the direction M (and/or vice-versa) at a sufficient rate that permits the applied abrasive particles 36 to pass beyond the channels 62 without experience an overt applied force by the strands 60 (i.e., the applied abrasive particles 36 are not forced to fall over due to contact with one of the stands 60).

The distribution tools and corresponding abrasive article manufacturing systems and methods of the present disclosure provide a marked improvement over previous designs. Abrasive particles are randomly loaded on to the distribution tool. In passing through the distribution tool and becoming applied to a backing, the abrasive particles are caused to become grossly oriented and aligned, with minimal costs and restrictions on through put time. Further, the distribution tool supports the oriented and aligned abrasive particles for a dwell period, enhancing the likelihood that the abrasive particles will retain the biased orientation. The distribution tools of the present disclosure are useful with any type or shape of abrasive particle, especially abrasive particles that are not well-suited for electrostatic coating.

Although the present disclosure has been described with reference to preferred embodiments, workers skilled in the art will recognize that changes can be made in form and detail without departing from the spirit and scope of the present disclosure.

What is claimed is:

1. A method for making an abrasive article comprising:

loading abrasive particles to a distribution tool, the distribution tool including a plurality of spaced apart elongated strips combining to define a plurality of channels, each of the plurality of channels being open to a lower side of the distribution tool; and distributing abrasive particles from the distribution tool on to a major face of a backing construction web located immediately below the lower side of the distribution tool;

wherein at least a majority of the abrasive particles distributed from the distribution tool undergo a particle orientation sequence in which each abrasive particle of the at least a majority of abrasive particles:

a) enters one of the plurality of channels, b) passes partially through the corresponding channel such that a first portion of the abrasive particle is beyond the lower side and in contact with the major face, and a second portion of the abrasive particle is within the channel, c) remains in simultaneous contact with at least one of the strips and the major face for a dwell period.

2. The method of claim 1, wherein the step of distributing abrasive particles includes a plurality of the abrasive particles simultaneously within a respective one of the channels.

3. The method of claim 1, wherein the step of distributing abrasive particles includes a plurality of abrasive particles simultaneously in contact with the major face and a first one of the strips as part of the corresponding orientation sequence.

4. The method of claim 1, wherein the step of distributing abrasive particles includes the abrasive particles causing the strips to vibrate.

5. The method of claim 1, wherein each of the plurality of channels is defined by a length greater than a width, and further wherein the distribution tool is arranged such that a direction of the length of each of the channels is substantially parallel with a machine direction of the moving web.

6. The method of claim 5, wherein each of the channels extends in a length direction from an entrance side of the distribution tool to an exit side of the distribution tool, the entrance side being located upstream of the exit side relative to a machine direction of the moving web, and further wherein the step of loading includes directing the abrasive particles to the entrance side.

7. The method of claim 1, wherein at least 75% of the abrasive particles distributed from the distribution tool undergo the particle orientation sequence.

8. The method of claim 1, further comprising:

providing a supply of abrasive particles for loading to the distribution tool, the abrasive particles of the supply of abrasive particles having a nominal maximum length, a nominal maximum height, and a nominal maximum thickness, the nominal maximum length and the nominal maximum height being greater than the nominal maximum thickness, and further wherein a width of each of the channels is less than the nominal maximum length and the nominal maximum height.

9. The method of claim 8, wherein the width of each of the channels is greater than the nominal maximum thickness.

10. The method of claim 1, wherein the orientation sequence for at least some of the abrasive particles includes:

initially contacting the major face with a first spatial orientation; and self-adjusting to a second spatial orientation while the first portion remains in contact with the major face and the second portion is within the confines of the corresponding channel.

11. The method of claim 1, wherein following the step of distributing abrasive particles from the distribution tool, the distributed particles are free of contact with the distribution tool, the method further including at least some of the distributed abrasive particles tilting relative to the major face due, at least in part, to gravity.

12. The method of claim 1, wherein the backing construction web includes a make coat along a major surface of a backing.

13. The method of claim 1, wherein each of the strips is a string.

14. The method of claim 1, wherein the step of distributing includes moving one of the backing construction web and the distribution tool.

15. The method of claim 1, wherein the step of distributing includes the backing construction web and the distribution tool remaining stationary relative to one another.

16. A system for making an abrasive article comprising:

a distribution tool defining an entrance side, an exit side, and a lower side, the tool including a plurality of spaced apart elongated strips combining to define a plurality of channels, extending between the entrance and exit sides, wherein each of the channels being open to the lower side tool; and wherein each of the channels defines a length and a width, the length being greater than the width;

a web feeding device configured to manipulate a backing construction web in a machine direction immediately below the lower side of the distribution tool;

an abrasive particle feed device configured to dispense a plurality of abrasive particles from an outlet;

wherein the outlet is arranged over the entrance side of the distribution tool.

17. The system of claim 16, wherein the elongated strips are substantially parallel with one another.

18. The system of claim 16, wherein the width of the channels is substantially identical.

19. The system of claim 16, wherein a size of a gap between the strips and the backing construction web at the entrance side is greater than a size of the gap at the exit side.

20. The system of claim 16, wherein each of the strips is a string.

* * * * *